US012448889B2

(12) United States Patent
Wagner et al.

(10) Patent No.: US 12,448,889 B2
(45) Date of Patent: Oct. 21, 2025

(54) RAISE CAVING METHOD FOR MINING DEPOSITS, AND A MINING INFRASTRUCTURE, MONITORING SYSTEM, MACHINERY, CONTROL SYSTEM AND DATA MEDIUM THEREFOR

(71) Applicant: LUOSSAVAARA-KIIRUNAVAARA AB, Luleå (SE)

(72) Inventors: Horst Wagner, Leoben (AT); Tobias Ladinig, Diex (AT); Matthias Wimmer, Jukkasjärvi (SE)

(73) Assignee: LUOSSAVAARA-KIIRUNAVAARA AB, Luleå (SE)

( * ) Notice: Subject to any disclaimer, the term of this patent is extended or adjusted under 35 U.S.C. 154(b) by 114 days.

(21) Appl. No.: 17/999,198

(22) PCT Filed: May 20, 2021

(86) PCT No.: PCT/SE2021/050477
§ 371 (c)(1),
(2) Date: Nov. 17, 2022

(87) PCT Pub. No.: WO2021/236002
PCT Pub. Date: Nov. 25, 2021

(65) Prior Publication Data

US 2023/0203946 A1 Jun. 29, 2023

(30) Foreign Application Priority Data

May 20, 2020 (SE) ..... 2050595-4
May 12, 2021 (SE) ..... 2150606-8

(51) Int. Cl.
*E21C 41/16* (2006.01)
*E21B 7/04* (2006.01)
(Continued)

(52) U.S. Cl.
CPC ..... *E21C 41/16* (2013.01); *E21B 7/04* (2013.01); *E21C 37/00* (2013.01); *E21C 39/00* (2013.01); *F42D 3/04* (2013.01)

(58) Field of Classification Search
CPC ..... E21C 41/16; E21C 37/00; E21C 39/00; E21B 7/04; F42D 3/04
See application file for complete search history.

(56) References Cited

U.S. PATENT DOCUMENTS 473,734 A 4/1892 Forrester
1,842,664 A * 1/1932 Elsing ..... E21C 41/16 299/33
(Continued)

FOREIGN PATENT DOCUMENTS

AU 2036999 A 9/1999
AU 2029402 A 9/2002
(Continued)

OTHER PUBLICATIONS

International Preliminary Report on Patentability in International Application No. PCT/SE2021/050477 dated Apr. 22, 2022 in 6 pages.
(Continued)

*Primary Examiner* — Carib A Oquendo
(74) *Attorney, Agent, or Firm* — Knobbe, Martens, Olson & Bear, LLP

(57) ABSTRACT

The present invention relates to an integrated raise caving mining method for mining deposits in rock mass comprising: developing at least one raise (102,102*a-f*,202,302*a-g*, 402*a-e*) in the rock mass (10), developing a drawbell (100, 100*a-c*, 200*a-g*,300*a-f*,400*a-e*) in the rock mass (10), wherein at least a portion of the drawbell is excavated from the at least one raise (102,102*a-f*,202,302*a-g*,402*a-e*), initiating caving through undercutting, wherein at least a part of an undercut is created by gradually expanding the drawbell
(Continued)

(100,100*a-c,* 200*a-g,*300*a-f,*400*a-e*) in upwards direction by excavation, developing at least two drawpoints (106,206, 406) into the drawbell (100,100*a-c,* 200*a-g,*300*a-f,*400*a-e*), wherein the drawpoints (106) are developed from drifts (115,207,407) arranged on different levels and progressively drawing fragmented rock (101) from the at least one drawbell through the drawpoints (106,206,406). The present invention also relates to use of an integrated raise caving mining method for mining deposits. The present invention also relates to an integrated raise caving mining infrastructure, a machinery, a control system of an integrated raise caving mining infrastructure, and a data medium.

26 Claims, 19 Drawing Sheets

(51) Int. Cl.

| | |
|---|---|
| ***E21C 37/00*** | (2006.01) |
| ***E21C 39/00*** | (2006.01) |
| ***F42D 3/04*** | (2006.01) |

(56) References Cited

U.S. PATENT DOCUMENTS

| | | | | |
|---|---|---|---|---|
| 2,536,869 | A | 1/1951 | Bucky | |
| 3,068,654 | A * | 12/1962 | Warren | E21D 13/00 299/10 |
| 3,438,325 | A | 4/1969 | Martin | |
| 3,615,351 | A | 10/1971 | Happel et al. | |
| 3,635,456 | A | 1/1972 | Anthes et al. | |
| 3,645,717 | A | 2/1972 | Meyer et al. | |
| 3,696,703 | A | 10/1972 | Fox | |
| 3,707,307 | A | 12/1972 | Kristoffersson et al. | |
| 3,748,120 | A | 7/1973 | Beggs et al. | |
| 3,779,741 | A | 12/1973 | Celada et al. | |
| 3,897,107 | A | 7/1975 | Haglund | |
| 3,939,771 | A | 2/1976 | McReynolds | |
| 4,036,100 | A | 7/1977 | Hurley | |
| 4,040,329 | A | 8/1977 | Ljungberg | |
| 4,040,330 | A | 8/1977 | Matzér | |
| 4,060,034 | A | 11/1977 | Bowman et al. | |
| 4,072,352 | A | 2/1978 | Janelid | |
| 4,324,390 | A | 4/1982 | Driemeyer | |
| 4,377,310 | A | 3/1983 | Gubin et al. | |
| 4,501,199 | A | 2/1985 | Mashimo et al. | |
| 4,522,125 | A | 6/1985 | Marz | |
| 4,581,712 | A | 4/1986 | Perry et al. | |
| 4,592,282 | A | 6/1986 | Niemi et al. | |
| 4,603,910 | A * | 8/1986 | Laneus | E21D 13/00 299/13 |
| 4,813,358 | A | 3/1989 | Roberts | |
| 4,829,902 | A | 5/1989 | Sharpe | |
| 4,938,536 | A | 7/1990 | Lee | |
| 5,007,683 | A * | 4/1991 | Granskog | E21C 41/22 175/219 |
| 5,192,819 | A | 3/1993 | Baumgartner | |
| 5,198,613 | A | 3/1993 | Jenkins, Jr. | |
| 6,070,511 | A | 6/2000 | Palmer | |
| 6,123,394 | A * | 9/2000 | Jeffrey | E21C 41/16 166/308.1 |
| 6,132,489 | A | 10/2000 | Villarreal-Trevino | |
| 6,395,056 | B1 | 5/2002 | Villarreal-Trevino et al. | |
| 6,397,754 | B1 | 6/2002 | Perlid | |
| 7,175,690 | B2 | 2/2007 | Potter et al. | |
| 8,381,653 | B2 | 2/2013 | Zimmermann | |
| 9,062,953 | B2 | 6/2015 | Leppanen | |
| 9,243,879 | B2 * | 1/2016 | Thomson | F42B 3/10 |
| 9,273,368 | B2 | 3/2016 | Gordon | |
| 10,570,736 | B2 | 2/2020 | Wang | |
| 12,174,002 | B2 | 12/2024 | Petropoulos | |
| 2005/0161257 | A1 | 7/2005 | Finden et al. | |
| 2014/0150607 | A1 | 6/2014 | Gordon | |
| 2015/0259760 | A1 | 9/2015 | Eder et al. | |
| 2015/0275323 | A1 | 10/2015 | Hoffman | |
| 2018/0106584 | A1 | 4/2018 | Santos et al. | |
| 2019/0292887 | A1 | 9/2019 | Austin et al. | |
| 2023/0228193 | A1 | 7/2023 | Wagner et al. | |
| 2023/0384074 | A1 | 11/2023 | Petropoulos | |
| 2023/0392913 | A1 | 12/2023 | Petropoulos | |
| 2023/0400288 | A1 | 12/2023 | Petropoulos | |
| 2024/0124948 | A1 | 4/2024 | Eriksson et al. | |
| 2024/0279766 | A1 | 8/2024 | Sandberg et al. | |

FOREIGN PATENT DOCUMENTS

| | | | |
|---|---|---|---|
| AU | 766127 | B2 | 10/2003 |
| AU | 785047 | B2 | 9/2006 |
| CA | 703542 | A | 2/1965 |
| CA | 3176355 | A1 | 11/2021 |
| CN | 1029333 | C | 7/1995 |
| CN | 203837589 | U | 9/2014 |
| CN | 108253850 | A | 7/2018 |
| CN | 108374067 | A | 8/2018 |
| CN | 106894817 | | 11/2018 |
| CN | 110644997 | | 1/2020 |
| CN | 210293005 | U | 4/2020 |
| DE | 2106062 | A1 | 8/1971 |
| EP | 0018235 | A1 | 10/1980 |
| EP | 3222953 | A1 | 9/2017 |
| GB | 2532689 | A | 5/2016 |
| GB | 2577798 | A | 4/2020 |
| JP | S53-107683 | U | 8/1978 |
| JP | 2006/002193 | A | 1/2006 |
| JP | 2012102371 | A | 5/2012 |
| KR | 20100039491 | A | 4/2010 |
| RU | 2706994 | C1 | 11/2019 |
| SE | 465566 | B | 9/1991 |
| SE | 2150180 | A1 | 8/2022 |
| SU | 262127 | A1 | 12/1977 |
| WO | WO 1995/030068 | | 11/1995 |
| WO | WO 1998/41811 | A1 | 9/1998 |
| WO | WO 2001/004563 | A1 | 1/2001 |
| WO | WO 2008/148544 | A1 | 12/2008 |
| WO | WO 2011/038449 | | 4/2011 |
| WO | WO 2011/100808 | | 8/2011 |
| WO | WO 2011/117394 | A1 | 9/2011 |
| WO | WO 2014/109755 | | 7/2014 |
| WO | WO 2017/214422 | A1 | 12/2017 |
| WO | WO 2020/039332 | A1 | 2/2020 |
| WO | WO 2021/183022 | A1 | 9/2021 |
| WO | WO 2021/241272 | A1 | 12/2021 |

OTHER PUBLICATIONS

International Search Report in International Application No. PCT/SE2021/050477 dated Jun. 23, 2022 in 13 pages.

Notice (4 Months) in Swedish Patent Application No. 2150606-8 dated Jun. 22, 2021 in 5 pages.

Final Notice (2 Months) in Swedish Patent Application No. 2150606-8 dated Feb. 22, 2022 in 4 pages.

Swedish Search Report in Swedish Patent Application No. 2150606-8 dated Jun. 22, 2021 in 2 pages.

Aquise Cornejo Rutber, "Cut and fill, chambers and pillars: underground mining methods",lhttps://www.gestiopolis.com/corte-y-relleno-camaras-y-pilares-metodos-demineriasubterranea/, Sep. 10, 2015.

Analysis of Induced Seismicity in the Rio Blanco Underground Mine, North Sector III Panel Areas 15, 16 and 17 Level 16 Collapsed Codelco Andina Division; Diego Romero Castro; Undergraduate thesis for the professional title of Geophysicist Concepción, Chile. Apr. 13, 2012: https://www.dgeo.udec.cl/wpcontent/uploads/2013/07/romero_diego_tesis.pdf.

"Is there potential for Block Caving in the country?"; Institute of Mining Engineers of Peru, Transcript of YouTube video uploaded on Aug. 16, 2013.

Mining Exploitation, https://www.ucursos.cl/ingenieria/2008/1/MI57E/1/material_docente/bajar?bajar=1&id=166065.

(56) References Cited

OTHER PUBLICATIONS

Manuel Enrique Aros Ulloa, "Stability of the production level in continuous mining", Thesis to Opt for the Title of Mining Civil Engineer, https://repositorio.uchile.cl/handle/2250/104852, University of Chile; Santiago de Chile, Oct. 2008.
"Room and Pillar", 2016, https://es.slideshare.net/LuisnArmandoLenCndor1/mtodo-de-room-and-pilar-59787116.
International Preliminary Report on Patentability for PCT/SE2021/051042 dated Nov. 17, 2022.
International Search Report and Written Opinion issued in International Application No. PCT/SE2022/051197, mailed on Jan. 23, 2023.
International Search Report and Written Opinion received in International Application No. PCT/SE2023/050293, mailed Jun. 14, 2023.
International Search Report and Written Opinion received in International Application No. PCT/SE2023/050298, mailed Jun. 7, 2023.
Atlas Copco: "Mining methods in underground mining", Second Edition, Dec. 31, 2007, Retrieved from the Internet: URL:https://batavia.internal.epo.org/citenpl/prod/web/citenpl/citenpl.html.
Bhaskar et al., "Decarbonization of the Iron and Steel Industry with Direct Reduction of Iron Ore with Green Hydrogen", Energies, 2020, 13, 758, in 23 pages.
Hudyma et al., "Monitoring open stope caving at Goldex Mine", Proceedings of the Secondinternational Symposium on Block and Sublevel Caving, Dec. 31, 2010, pp. 133-144.
International Search Report and Written Opinion in International Application No. PCT/SE2021/050475 dated Jun. 23, 2021 in 13 pages.
International Preliminary Report on Patentability in International Application No. PCT/SE2021/050475 dated Apr. 22, 2022 in 6 pages.
Notice (4 months) in Swedish Patent Application No. 2130072-8 dated Jun. 22, 2021 in 4 pages.
Final Notice (2 months) in Swedish Patent Application No. 2130072-8 dated Feb. 22, 2022 in 4 pages.
Swedish Search Report in Swedish Patent Application No. 2130072-8 dated Jun. 22, 2021 in 2 pages.
Notification of Transmittal of International Preliminary Report on Patentability for PCT/SE2021/051042 dated Nov. 1, 2021.
International Search Report and Written Opinion of the International Searching Authority for PCT/SE2021/051042 dated Nov. 1, 2021.
First Notice in Swedish Patent Application No. 2051234-9 dated May 5, 2021 in 9 pages.
Second Notice in Swedish Patent Application No. 2051234-9 dated Oct. 29, 2021 in 4 pages.
Third Notice in Swedish Patent Application No. 2051234-9 dated Jul. 7, 2022 in 4 pages.
Final Notice in Swedish Patent Application No. 2051234-9 dated Dec. 14, 2022 in 34 pages.
International Search Report and Written Opinion issued in International PCT Application No. PCT/SE2021/051040 dated Nov. 10, 2021 in 12 pages.
International Preliminary Report on Patentability for PCT/SE2021/051040 dated Nov. 24, 2022 in 16 pages.
First Notice and Search Report in Swedish Patent Application No. SE2051233-1 dated May 11, 2021 in 8 pages.
Second Notice for in Swedish Patent Application No. SE2051233-1 dated Nov. 8, 2021 in 4 pages.
Third Notice for in Swedish Patent Application No. SE2051233-1 dated Mar. 31, 2023 in 4 pages.
International Search Report / Written Opinion of International Searching Authority for PCT/SE2021/051036 dated Nov. 1, 2021 in 11 pages.
International Preliminary Report on Patentability for PCT/SE2021/051036 dated Nov. 17, 2022 in 30 pages.
First Notice and Search Report in Swedish Patent Application No. SE2051232-3 dated May 5, 2021 in 12 pages.
Second Notice in Swedish Patent Application No. SE2051232-3 dated Oct. 29, 2021 in 4 pages.
Third Notice in Swedish Patent Application No. 2051232-3 dated Jul. 15, 2022 in 6 pages.
Eurasian Office Action in Eurasian Application No. 202293280 dated Apr. 5, 2023 in 5 pages.
Eurasian Office Action in Eurasian Application No. 202293281 dated Apr. 7, 2023 in 5 pages.
Eurasian Office Action in Eurasian Application No. 202391192 dated Sep. 12, 2023.
Notice and Search Report for SE 2150180-4 dated Oct. 14, 2021 in 11 pages.
Notice and Search Report for SE 2150180-4 dated May 31, 2023 in 5 pages.
International Preliminary Report on Patentability for PCT/SE2022/050182 dated dated Feb. 8, 2023 in 35 pages.
International Search Report and Written Opinion of the International Searching Authority for PCT/SE2022/050182 dated May 20, 2022 in 16 pages.
International Search Report and Written Opinion issued in International Application No. PCT/SE2022/050557 dated Jun. 16, 2022 in 14 pages.
Office Action issued in Swedish Application No. 2150736-3 dated Jul. 1, 2022 in 4 pages.
Office Action issued in Swedish Application No. 2150736-3 dated Mar. 1, 2022 in 8 pages.
International Preliminary Report on Patentability for PCT/SE2022/050557 dated Apr. 20, 2023 in 14 pages.
Communication pursuant to Rule 114(2) EPC issued in EP Application No. 22756641.1, dated Feb. 22, 2024.
Extended European Search Report issued in European Patent Application No. 21809335.9 dated Jun. 25, 2024 in 16 pages.
Extended European Search Report issued in European Patent Application No. 21808020.8 dated Jul. 2, 2024 in 15 pages.

* cited by examiner 102a
118
100a
108
101
116
115

102a
118
109
116
100b
108
101
100a
115

10
102a
108
109
100a
101
102b
108
109
100b
118
115
106

102a
118
109
100a
108
101
102b
108
110
101
100b
116
106
115

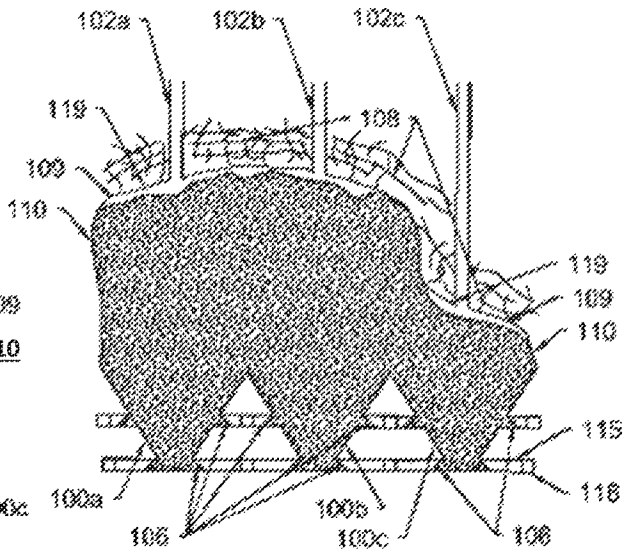
Fig. 4a
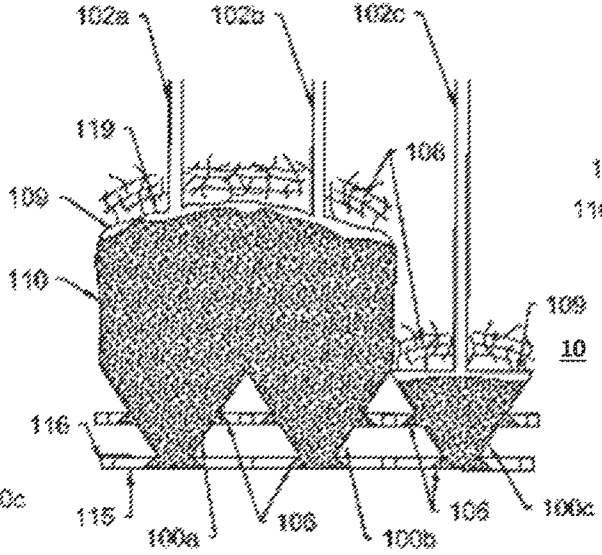
Fig. 4b
Fig. 4c

A–A

RAISE CAVING METHOD FOR MINING DEPOSITS, AND A MINING INFRASTRUCTURE, MONITORING SYSTEM, MACHINERY, CONTROL SYSTEM AND DATA MEDIUM THEREFOR

TECHNICAL FIELD

The present invention relates to a cave mining method for mining deposits and the use thereof.

The present invention also relates to a cave mining infrastructure, a machinery, a control system of a cave mining infrastructure, and a data medium.

BACKGROUND ART

Cave mining methods are applied for underground extraction of mineral deposits. Prior art cave mining methods (also referred to as caving methods) include block caving, panel caving, sublevel caving, inclined caving and variations of these methods. The concept of cave mining relies on that during the mining operation a part of the rock mass caves such as the ore body itself, the rock formations near the ore body, the overlying hangingwall, or a combination thereof. Caving is an engineered, natural failure process of rock mass. Particularly, cave mining methods are associated with low extraction cost. Therefore, cave mining methods are suitable for mining low-grade mineral deposits, which are massive and have a large volumetric extent.

In prior art cave mining methods relying on caving of the ore body, the following main method steps can be distinguished: undercutting, production, and pre-conditioning. In caving methods where the ore body is engineered to cave, such as block caving, inclined caving, or panel caving, caving of the ore body is typically achieved by undercutting the ore body. When undercutting, a void is created by drilling and blasting such that the void obtains a dimension, which is large enough to initiate caving.

After the ore body has been undercut and caving has been initiated, broken ore is drawn through drawbells accessed through drawpoints located at a single production level. As ore is drawn, a void is formed and maintained above the broken, caved rock mass and caving can progress upwards subsequently, whereby a caving stope is formed. The void has to be large enough to absorb the swell of caved rock.

If the ore body rock mass is too strong for enabling cave progression under prevailing stress conditions at an acceptable caving rate, or if no caving occurs at all or pre-conditioning methods may be implemented to decrease rock mass strength.

Each of the main method steps undercutting, production and pre-conditioning require typically different types of infrastructure and work processes.

Undercutting is commonly conducted from undercut drifts on a so-called undercut level where the undercut is created by means of drilling and blasting of pillars between neighboring undercut drifts on retreat. The production is normally conducted from production level drifts on a so-called production level. Drifts, drawpoints, and drawbells have to be developed by means of drilling and blasting, whereby drawpoints and drawbells connect the production level to the undercut area. Furthermore, pre-conditioning measures are typically applied from drifts at so-called pre-conditioning levels by for example hydraulic fracturing and/or confined blasting.

The requirements on the infrastructure and work processes are different for each of the main method steps. Thus, in prior art caving methods the main method steps undercutting, production, and pre-conditioning must be implemented in a stepwise and subsequent manner.

Furthermore, in prior art cave mining methods such as block caving, the undercut and production levels must be proximal due to ore flow considerations. The spacing between drawpoints is dependent on the actual spacing of production and undercut level. The drawpoint spacing must not exceed certain distances to realize an acceptable ore flow in caving stopes. Therefore prior art caving methods such as block caving require numerous, small drawbells to implement an appropriate drawpoint spacing, implying that at the production level there are numerous, small drawbells and drawpoints which are separated by small pillars. Moreover, drawbell development is intense and difficult but it is crucial for ore flow and operational performance. However, the small size of drawbells hinders proper stimulation of the ore flow and limits access. Frequent hang-up occurrences resulting from the small drawbell sizes negatively affect production, productivity, and ore flow. Hang-up clearance is difficult. Furthermore, the spacing varies between the drawpoints, and draw zones are not evenly distributed. Thereby, a non-uniform ore flow may result causing early dilution, poor ore recovery, and even rock mechanical problems at the production level. The close distance between the production level and undercut level also causes major rock mechanical problems. Significant stress changes in the rock mass from undercutting result in extreme stresses at the boundaries of the undercut area, referred to as abutment areas.

In block caving the undercut level and the production level are situated in and affected by the abutment area. Infrastructure at the undercut level and/or the production level may be damaged because of the high stresses necessitating repair before production. Undercut drilling and blasting is complicated and hazardous as the undercut is in the abutment zone, prone to high stresses. At the production level, the small pillars separating drawpoints and drawbells are prone to stress damage. This rock mass damage is immanent and may cause ongoing, long-term, persistent stability problems during lifetime of the operation.

Furthermore, the ramp-up time of prior art cave mining methods is very long and may exceed 10-15 years with considerably high associated cost. Rock mechanics and logistics issues hinder faster ramp-up time. Additionally, financial returns are only generated after production has commenced. Furthermore, design decisions need to usually be locked in an early stage, when access to actual information related to deposit shape, rock mass properties etc. is still very limited. This circumstance may result in incorrect decisions bearing considerable risks during the later run of operation.

Moreover, there is limited or no access to the ore body above the undercut. Thus, the possibility to control the direction of cave progression is very limited. Furthermore, active control through specific and/or on demand rock breaking methods is very difficult and costly to implement in prior art cave mining methods. Hence, prior art cave mining methods require extensive monitoring programs to follow the cave progress. In case of cave stall or unwanted cave progression direction, access points are not readily available for instant remedies.

However, the application of cave mining methods remains attractive, mainly due to the provided high productivity in combination with low extraction costs. Thus, there is a current trend to apply cave mining methods to deeper and more competent ore bodies and to ore bodies with less favorable geometries for caving. These conditions intensify the above-mentioned rock mechanics and logistics issues.

In conclusion, prior art cave mining methods are associated with long development times, complex preparation plans, complex schedules, high development cost, very little flexibility, very little possibilities for adaptations, and high risks. In addition, thereto, the trend to mine deeper, more competent, and lower grade ore bodies aggravates the risks significantly.

SUMMARY OF THE INVENTION

In view of prior art cave mining methods it is desirable to achieve a cave mining method for mining ore from a deposit in rock mass which solves or at least alleviates some of the drawbacks of the prior art.

There is one object to provide a cave mining method for mining deposits which improves the safety when cave mining.

There is one object to provide a cave mining method for mining deposits which reduces the risks associated with cave mining.

There is one object to provide a cave mining method which reduces the ramp-up time for developing a cave mine.

There is one object to provide a cave mining method which reduces costs for developing the cave mine.

There is one object to provide a cave mining method which reduces the requirement for pre-development of infrastructure prior to production.

There is one object to provide a cave mining method which increases the profitability and enhances the applicability of cave mining.

There is one object to provide a cave mining method which provides improved stability of the infrastructure.

There is one object to provide a cave mining method which improves interactive draw over larger areas.

There is one object to provide a cave mining method which provides reduced risk of early dilution.

There is one object to provide a cave mining method which provides reduced probability of hang-ups.

There is one object to provide a cave mining method which reduces the infrastructure amount for undercutting.

There is one object to provide a cave mining method which provides that drilling and blasting work for drawbell development and undercutting can be remote controlled or automated.

These or at least one of said objects are achieved by an integrated raise caving mining method as claimed in claim 1, wherein further embodiments are incorporated in the dependent claims.

Hence, according to one aspect the present invention relates to an integrated raise caving mining method for mining deposits in rock mass comprising:

- developing at least one raise in the rock mass,
- developing a drawbell in the rock mass, wherein at least a portion of the drawbell is excavated from the at least one raise,
- initiating caving through undercutting, wherein at least a part of an undercut is created by gradually expanding the drawbell in upwards direction by excavation,
- developing at least two drawpoints into the drawbell, wherein the drawpoints are arranged on different levels,
- progressively drawing fragmented rock mass from the at least one drawbell through the drawpoints.

The integrated raise caving mining method advantageously combines and therefore integrates the method steps drawbell development, undercutting, initiating of caving, caving and optionally pre-conditioning and optionally pre-breaking in that all these method steps may be implemented from the same raise in parallel or within a short time frame.

The integrated raise caving mining method comprises that the at least one raise is developed in rock mass. A raise refers to a longitudinally extended vertical or inclined mine infrastructure opening. The raise is typically configured with a circular cross-section. The at least one raise may for example be developed from a tunnel, drift, level or other accessible infrastructure in the rock mass. The raise may for example be developed between two levels arranged on different elevations in the rock mass. The at least one raise may be developed in upwards direction by for example raise boring techniques, or alternatively the at least one raise may be developed in downwards or upwards direction by other conventional methods.

Preferably, the raise is developed within an area in the rock mass where the drawbell is intended to be developed.

The orientation and/or position of the raise may be adapted to local requirements in terms of ore body geometry and/or stress situation and/or rock mass properties.

In one embodiment of the invention, the method comprises that the raise is vertical.

Alternatively, the raise may be inclined.

In one embodiment of the invention, the method comprises that the at least one raise is developed to extend over the full stope height. In such case the raise may be developed to extend from the bottom of the drawbell to a level located at the top of the stope.

In one embodiment of the invention, the method comprises that the at least one raise is developed to extend over only a part of the stope height above the drawbell. In such case the at least one raise is developed to extend from the bottom of the drawbell to an additional level arranged between the drawbell and the ultimate top of the stope. However, the raise may also be developed between two levels, which are located above the drawbell, thereby the drawbell extends only over a part of the stope height.

In one embodiment of the invention, the method comprises that the at least one raise is located in rock mass within the perimeter of the drawbell roof.

The at least one raise may be located in the center of the drawbell roof. Alternatively the at least one raise may be located offset from the center of the drawbell roof. Thus, the raise is positioned outside the center of the drawbell roof. In one embodiment of the invention, the method comprises that the at least one raise is located in rock mass outside the perimeter of the drawbell roof. In one embodiment of the invention, the method comprises that the drawbell is excavated at least partially from a raise which is located in rock mass outside the perimeter of the drawbell roof. In one embodiment of the invention, the method comprises that the drawbell is excavated from more than one raise. Several raises may be developed in the rock mass within the region where the drawbell is intended to be constructed such that the drawbell is constructed by excavation from several raises.

Evidently, the integrated raise caving mining method may comprise that multiple drawbells are excavated in a mining area.

The integrated raise cavinge mining method comprises that a drawbell is developed in the rock mass. The drawbell is configured to receive fragmented rock material from a caving stope located above the drawbell. The drawbell comprises a drawbell bottom and a drawbell roof, which are joined by sidewalls. Preferably, the drawbell is configured with a drawbell roof area being larger than a bottom area of the drawbell. In such case the drawbell widens in a direction upwards. The area of the horizontal cross-section of the drawbell may vary in upwards direction.

Typically the area of the horizontal cross-section of the drawbell gradually increases in upwards direction. The drawbell may for example be configured as an inverted pyramid, a trough or an inverted cone. Alternatively, the area of the horizontal cross-section may be constant, or nearly constant along a section of the drawbell. The drawbell may for example be configured as an inverted cone further provided with a cylindrical section adjacent the drawbell roof.

The integrated raise cavinge mining method comprises that at least a portion of the drawbell is excavated from the at least one raise. For example the lowermost portion of the drawbell may first be excavated by drilling, charging and blasting operations conducted by conventional means from the production level or a drift located in the rock mass. Thereafter the remaining portion of the drawbell is developed by excavation from the at least one raise from inside the raise. Alternatively the complete drawbell is developed by excavation from the at least one raise.

In one embodiment of the invention, the portion of the drawbell is excavated by drilling blast holes into the rock mass around the raise by operating a machinery arranged inside the raise, and blasting the rock mass by charging and detonating explosives in those blast holes such that the portion of the drawbell is blasted.

The drawbell development from the at least one raise provides an advantageous synergizing potential. However, in order to benefit from this potential the drawbell must exceed a certain critical size. The drawbell must be of a sufficient size in order minimize the number of raises. In such way the economy of the mining operation is acceptable from a cost perspective.

The combined application of using at least one raise for drawbell development and the provision of a drawbell of considerable size drastically reduces the ramp-up time of a cave mining operation, allowing using and sharing of the same infrastructure and similar work processes enabling parallel implementation of the method steps drawbell development, undercutting, initiating of caving, and, optionally, pre-conditioning and pre-breaking in the stope.

Accordingly, the drawbell is developed to obtain a considerable size which exceeds a critical size, otherwise the advantages regarding ramp-up time, parallelization, and synergizing effects do not materialize.

The development of the drawbell from the raise allows establishing a much larger drawbell. Moreover, the drawbell can be utilized for undercutting as well. This is a major advantage over prior art cave mining methods where the undercut level usually is located close to the production level and the production level layout is configured with numerous small drawbells to implement an appropriate drawpoint spacing, necessary to achieve an acceptable ore flow in a caving stope of prior art cave mining methods. Thus, the small sized drawbells of prior art production level layouts would not provide the same advantage.

For the purpose of constructing the drawbell by excavation, suitable machinery is arranged inside the raise. Moreover, said machinery may also be used for stope excavation, such as for example pre-breaking.

The machinery comprises a drilling and/or charging machinery configured for drilling and/or charging the rock mass from inside the raise, which machinery comprises a drilling bore and/or charging equipment configured for initiating said caving. The machinery may also comprise hydraulic fracturing equipment. The machinery is arranged on a platform which is movable within the raise such that it can be hoisted down through the raise to a location of operation.

Preferably the machinery is configured to be operated by remote control. Alternatively, the machinery is configured for semiautomation or full automation. Thereby it is avoided that machine operators have to be present inside the raise. Since the raise is preferably configured with a circular cross-section remote control or automation of the machinery is facilitated The platform must be designed such that it can still be moved inside the raise, even in the case of rock mass deformations occurring in the raise.

The shaft hoist system is located in a specifically excavated infrastructure excavation, which size and shape is adapted to the requirements of the hoist system and/or rock mechanics considerations. In order to keep the infrastructure excavation of the hoist system 104 small, a modular design of the platform and/or machinery mounted on the platform is advantageous.

A small infrastructure excavation provides an improved stability. The modular design allows changing of utilized machinery quickly.

The machinery mounted onto the platform is adapted to operational requirements. Possible types of machinery comprise amongst others machinery for drilling, machinery for charging, machinery for support installation or machinery for hydraulic fracturing.

In one form of the invention, the platform may also be stored by moving it aside from the top of the raise. Thus the platform is configured to be moved to the side at the top of the raise to be stored in a storage position.

The blast initiation can be carried out with different options, which comprise amongst others non-electric detonators, detonators initiated through an electric signal transferred via cable or detonators initiated wirelessly by means of communication through rock mass.

In another form of the invention, more than one slice could be blasted in a single blast. Thereby an appropriate time delay between individual slices is required.

In one embodiment of the invention, the mining method comprises that excavation of the portion of the drawbell is performed by blasting slices of rock mass. The shape of the slices depends on the inclination of the boreholes. Preferably, the portion of the drawbell is excavated by drilling blast holes into the rock mass around the raise by operating the machinery arranged inside the raise, and blasting the rock mass by charging and detonating explosive charges in those blast holes such that slices of rock mass are blasted.

The excavation and development of the drawbell commences at the bottom of the drawbell. Preferably, the blasting progresses in upwards direction by drilling and blasting slices of rock mass with the machinery arranged inside the raise.

Typically, blast holes are drilled to be straight by conventional techniques, which provide a limited control of drill precision and accordingly limit the maximum possible blast hole length. However, it may be advantageous to apply directional drilling. Directional drilling may be applied for better control of drill precision and/or to accomplish very large drill- and blast design by drilling curved boreholes.

In one embodiment of the invention, the method comprises that blasting takes place in an unconfined environment by drawing previously blasted rock from the drawbell to create a void.

Blasting of the drawbell takes place in an unconfined environment by gradually drawing rock mass from the drawbell thereby creating a void. Sufficient voids must exist to absorb the swell of fragmented rock resulting from blasting. Before the next blast holes can be fired, enough broken rock mass must be drawn from the drawbell. Due to unconfined blasting, rock breakage problems leading to remnant pillars are not expected. However, in case a remnant pillar is formed, it can be detected and measures against the remnant pillar may be implemented. Moreover, the availability of the raise improves the access and facilitates the applicability of measures against remnant pillars. Furthermore, the blasted rock is thrown predominately in the direction of gravity, assisting the blasting process further.

Drilling, charging and blasting continues upwards along the raise. In one embodiment of the invention, the method comprises that excavation of the portion of the drawbell is performed by blasting slices of rock mass. In one embodiment of the invention, the method comprises that the shape of individual blast slices are adapted to form a drawbell of a specific predetermined shape. In one embodiment of the invention, the method comprises that the drawbell is configured as an inverted pyramid. Alternatively, the drawbell may be configured as an inverted cone or a trough.

In one embodiment of the invention, the method comprises that the shape of the at least one drawbell is configured to be adaptable according to the ore body geometry and/or rock mass properties and/or ore flow considerations and/or stress situation.

In one embodiment of the invention, the method comprises that the dimension of the at least one drawbell is adapted to local requirements in terms of ore body geometry and/or stress situation and/or rock mass properties and/or ore flow considerations.

In one embodiment of the invention, the method comprises that the drawbell is configured to be oriented in a predetermined direction.

In one embodiment of the invention, the method comprises that the drawbell is configured to be oriented such that the production level infrastructure is positioned favorably related to the prevailing stresses.

In one embodiment of the invention, the method comprises that the drawbell is configured to be oriented such that cave initiation is facilitated by the prevailing stresses.

A free surface for blasting is obtained and/or maintained which coincides with the drawbell roof and provides a favorable condition for later cave initiation. Basically, blasting transforms into caving of the rock mass when the drawbell is excavated in upwards direction.

The integrated raise cavinge mining method comprises that caving is initiated through undercutting wherein at least a part of an undercut is created by gradually expanding the drawbell in upwards direction by excavation.

In such a way the area of the drawbell roof is increased, such that at least a part of the undercut is created by the drawbell. This is particularly advantageous in that a separate undercut level, which would otherwise have to be developed, is not required. Thus by gradually expanding the drawbell in upwards direction the drawbell roof becomes larger than the bottom of the drawbell. However, the drawbell may also be gradually expanded in the upwards direction without increasing the length of the perimeter of the drawbell roof. In such a way, a section of the drawbell may be provided with a horizontal cross-section having constant or nearly constant area in upwards direction.

In one embodiment of the invention, the method comprises that at least a part of the undercut is created by gradually expanding the drawbell in the upwards direction without increasing the length perimeter of the drawbell roof.

Alternatively, at least a part of the undercut is created by gradually expanding the drawbell upwards in vertical direction by excavation.

Preferably the rock mass located above the drawbell caves, thereby forming a stope. Caving is initiated subsequently to creating the undercut. Thereby, caving is initiated when the area of the undercut exceeds a critical area, which is a function of rock mass properties, stress situation, and the shape of the undercut. The critical area for caving of different types of rock mass and different location is well researched in the field, and may be estimated by the skilled person.

In one embodiment of the invention, the method comprises performing drawbell development and undercutting simultaneously. The gradual expansion of the drawbell, whereby the drawbell roof area is gradually increased, is part of the undercutting process. In such a way, the ramp-up time can be shortened in comparison with prior art methods. Also, the drawbell serves as an initial source of ore due to its size. Therefore, some ore can already be produced in the ramp-up stage of the operation.

In one embodiment of the invention, the method comprises that drawbell development and undercutting transitions seamlessly into caving of the rock mass located above the undercut.

The free surface obtained by blasting slices of rock mass promotes efficient blasting and seamless transition to subsequent caving. Moreover, blasting of slices of rock mass in the drawbell is performed in a preferred direction which corresponds to the later caving direction.

In such way a more stable initial production phase with a high caving rate is expected. Overall, the integrated development of drawbell and undercut can be regarded as simple and controllable.

Alternatively blasting takes place in a semi-confined environment by drawing previously blasted rock from the drawbell without creating a void.

In such case there is not a void between the fragmented rock mass and the drawbell roof. Thereby, the fragmented rock mass provides support to the drawbell roof and enhances its stability. Indeed, there is not a free surface for blasting of subsequent slices anymore. Blasting takes now place against fragmented rock mass and the blast environment is therefore referred to as semi-confined. Such semi-confined blast conditions may be particularly advantageous at the time shortly before the drawbell roof area exceeds the critical area for initiation of caving. In this state, the additional support provided by the fragmented rock mass still provides a stable drawbell roof and enables blasting subsequent slices required for cave initiation.

In one embodiment of the invention, the method comprises that the shape of individual blast slices is adapted to form a drawbell of a specific predetermined shape. By drilling the boreholes in different angles, charging and blasting the boreholes, different parts of the rock mass are blasted such that a specific shape of the drawbell may be obtained.

In one embodiment of the invention, the method comprises blasting several slices in one blast shortly before cave initiation may be advantageous in this transformation stage. Blasting several slices in one blast requires appropriate timing between individual slices to achieve a satisfying blast result.

When the area of the undercut exceeds a critical area required for cave initiation, the caving process is initiated and progresses upwards.

When caving progresses further upwards a stope is formed above the drawbell. Typically, a zone of fractured rock mass forms at the cave back. A part of rock mass detaches from the in-situ rock mass and piles up in the caving stope. It is important to keep a void between the cave back and the broken mass inside the caving stope. This void is required for cave progression. Continuous draw of ore enables continuous cave progression.

To accomplish a sufficient void, a proper draw strategy must be implemented. However, the formation of excessive void leads to the risk of an air blast and must be avoided.

In one embodiment of the invention, the method comprises scheduled switching from caving to drilling and blasting in specific areas in a part of the stope for a limited time period by operating the machinery arranged inside the raise located in the rock mass. Production by caving is preferred from a cost perspective. However, intermittent drilling and blasting may be performed depending on the rock mass and the cave progression.

In one embodiment of the invention, the method comprises switching from caving to drilling and blasting on demand. In case the rock mass cannot be reliably and safely caved, or in case the ore body geometry demands it, switching to drilling and blasting may be required during a period before continuation of caving.

In one embodiment of the invention, the method comprises re-initiating caving of the stope is done by pre-breaking by drilling, charging and blasting in a part of the stope in specific areas from inside the raise by operating the machinery arranged inside the raise in case caving has stalled.

In one embodiment of the invention the method comprises joining at least two drawbells and forming a coherent stope above the drawbells and caving the coherent stope. Thereby, the undercut of the at least two drawbells are joined such that a larger unsupported area is formed.

By connecting at least two drawbells, a significantly larger stope can be formed which increases production.

In one embodiment of the invention, the method comprises enlarging a caving stope in lateral direction by means of development of an additional drawbell located next to the caving stope.

Preferably, the roof of the additional drawbell is connected to a caving stope, which has progressed further than said drawbell roof.

The integrated raise cavinge mining method comprises developing at least two drawpoints into the drawbell, wherein the drawpoints are arranged on different levels.

In particular, the levels are located on different elevations in relation to the drawbell. In such way the drawbell may be configured with large dimensions. The at least two drawpoints are particularly important for achieving a good ore flow in such a large scale drawbell.

The drawpoints may be arranged in a predetermined pattern for example staggered such that the material flow is stimulated to achieve an appropriate interactive draw zone. The levels may be productions levels, herein also referred to as draw levels.

Preferably, the drawpoints are developed from drifts arranged on different levels.

Preferably, at least one drawpoint is developed from a drift located on a first production level located at the bottom of the drawbell and at least one drawpoint is developed on a different production level, elevated above the first production level. Alternatively at least one drawpoint is developed from a drift arranged on a first production level located between the bottom of the drawbell and the roof of the drawbell and at least one drawpoint is developed on a different production level, elevated above the first production level. Preferably, the drifts are developed adjacent to the drawbell however the location and configuration of the drifts may be adapted to the rock mass and/or stress situation and/or mining layout.

Due to the shape of the drawbell, only a few drawpoints are required at the drawbell prior to initiation of caving. The blasted rock mass from drawbell development is drawn at these drawpoints. For this reason, the required infrastructure development at the production level(s) is limited in the ramp-up phase. After caving has been initiated, the remaining parts of the production level(s) are developed such as further production levels adjacent the drawbell and/or the caving stope. Thus, the requirement of infrastructure pre-development is reduced in comparison with prior art cave mining methods.

The integrated raise cavinge mining method comprises progressively drawing fragmented rock mass from the at least one drawbell through the drawpoints.

During production, caved fragmented rock mass falls into the drawbell and moves down to the drawpoints where it is drawn by suitable machinery such as loaders or continuous draw machinery with conveyors.

In one form of the invention, the method comprises developing at least one additional drawpoint into the drawbell and developing said at least one additional draw point on the same level as pre-existing drawpoints or on a different level than pre-existing drawpoints to stimulate material flow in the drawbell.

The additional drawpoint(s) may be developed after completion of the drawbell development or after caving has been initiated. Such late development protects the additional drawpoint(s) from high stresses during drawbell development and corresponding undercutting as well.

Furthermore, the position of the drawpoints may be adapted to local rock mass conditions and/or ore flow considerations.

In one embodiment of the invention, the method comprises developing at least one additional drawpoint into the stope arranged above the drawbell. To improve the ore flow, further drawpoints may be developed into the stope above the drawbell.

In one embodiment of the invention, the method comprises adapting the position of the drawpoint(s) relative to the drawbell and/or stope. Preferably the drawpoint(s) is (are) positioned such that ore flow is improved.

In one embodiment of the invention, the method comprises providing the drawbell with at least one additional production level having at least one drift. The additional production level may be provided with one or more additional drawpoints with drifts providing access to the drawpoints.

Thus, further production levels and drawpoints may be developed and added during the mining operation, thereby reducing requirement for infrastructure pre-development and increasing flexibility.

In one embodiment of the invention, the method comprises developing at least one rock pass between at least two production levels. The rock pass is used for the transport of broken rock mass between the production levels. In deep underground mines it is common practice to transport the broken rock mass by means of gravity to the deepest level in the mine from where it is hoisted to surface.

In one embodiment of the invention, the method comprises developing said additional drawpoints from one direction into the drawbell and/or stope. Thus, since the drifts provide access to drawpoints, the drifts of the production level may be developed and oriented in required direction. The additional drawpoint may also be arranged on the same production level as an earlier developed drawpoint to improve the ore flow.

Alternatively, in one embodiment of the invention, the method comprises developing said additional drawpoints from different directions into the drawbell and/or stope, for example in opposite directions. The drifts providing access to said drawpoints should thus be oriented in different directions. The additional drawpoints may be arranged on the different production levels located on different sides of the drawbell to improve the ore flow.

To achieve favorable interactive draw improving the ore flow, drawpoints may be developed into the drawbell from different directions. Thus, the added drawpoints are then arranged on different sides of the drawbell.

In one embodiment of the invention, the mining method comprises that the location and/or shape of at least one drawpoint is adapted to local requirements during drawing fragmented rock from the stope. Thus, the drawpoints may be moved or re-established to adapt to the situation when for examples problems with draw occur.

The application of a large sized drawbell is advantageous as it reduces the risk of hang-ups. Moreover, since at least two drawpoints which are arranged on different levels are developed into the drawbell, the drawbell is accessible which facilitates removal of hang-ups.

The large size of the drawbell and the arrangement of drawpoints on different levels enable an optimized drawpoint positioning from an ore flow perspective. Thereby, the spacing of several neighboring drawpoints can be kept constant.

Drawing broken rock mass from a drawpoint maintains a specific flow of broken rock mass inside the drawbell towards said drawpoint. However, every drawpoint maintains the flow of broken rock mass only in a certain area. This area is commonly referred to as isolated draw zone. Correspondingly, a zone of relatively stationary material characterized by insignificant flow of rock mass remains between neighboring isolated draw zones.

In one embodiment of the invention, the method comprises developing the drawpoints at selected positions into the drawbell such that isolated draw zones corresponding to the drawpoints overlap at least in some areas. Thus, there is a smaller zone of relatively stationary material between neighboring isolated draw zones. In one embodiment of the invention, the method comprises performing interactive drawing from drawpoints within an individual drawbell. The interactive draw is realized by drawing broken rock mass concurrently from neighboring or adjacent drawpoints at the same time or within a short time interval. Interactive draw has the benefit that width of the draw zone is increased. Thus, a more efficient production is achieved and dilution is delayed.

In one embodiment of the invention, the mining method comprises providing the at least one drawbell with multiple drawpoints distributed over at least two levels and distributing said drawpoints evenly such that a favorable drawpoint spacing is achieved and drawing said drawpoints interactively such that interaction between isolated draw zones is achieved. As drawpoints are drawn interactively, isolated draw zones of individual drawpoints start to interact. Consequently, broken rock mass between neighboring isolated draw zones starts to move. Therefore, an interactive draw zone develops near isolated draw zones. Preferably a uniform draw both temporarily and spatially from drawpoints is pursued to enlarge the interaction in the interactive draw zone.

In one embodiment of the invention, the method comprises performing drawing of broken rock mass interactively from at least two neighboring drawbells and forming an interactive draw zone across drawbells. Thereby, the interactive draw in each drawbell results in larger drawbell interactive zones which interact across the drawbells.

The development of drawpoints on more than one draw level provides the possibility to improve the drawpoint arrangement from an ore flow point of view.

In one embodiment of the invention, the mining method comprises developing the drawpoints in a staggered, square or rectangular layout.

The layout refers to the position of isolated draw zone centers in the horizontal plane. A staggered layout improves the volumetric coverage of the isolated draw zones. The actual arrangement of drawpoints depends on local circumstances, such as the fragmentation of rock mass, the size and shape of drawpoints, the size and shape of drawbells, or the applied draw strategy.

The large size of the drawbell furthermore enables reduction of the number of neighboring drawpoints, in particular where the drawpoint spacing is not ideal, i.e. too large, or too small. Due to the latter drawpoint positioning improvements, interactive draw is promoted and significantly improved. Accordingly, the risk of early dilution is reduced. Overall, the large sized drawbell provides improvements from an ore flow perspective, which enable a higher productivity in comparison with prior art cave mining methods.

In one embodiment of the invention, the method further comprises pre-conditioning of rock mass located above the drawbell roof by operating the machinery arranged inside the at least one raise.

In one embodiment of the invention, the method further comprises performing pre-conditioning of rock mass located where the stope is intended to be positioned by operating the machinery arranged inside the at least one raise located in the rock mass. Pre-conditioning is advantageous in that it improves caveability and fragmentation of the rock mass. Typical pre-conditioning methods include hydraulic fracturing and/or confined blasting. Pre-conditioning may be performed in a part of the rock mass located above the drawbell.

In one embodiment of the invention, the method further comprises performing pre-conditioning measures in specific areas above the drawbell roof and on-demand. The rock mass may contain particularly competent rock formations, which have to be pre-conditioned. By performing pre-conditioning from the raise, access to critical rock mass formations is improved. In particular, where the position of the competent rock mass formation is such that it is foreseen to be a part of the stope under development as caving progresses. Preferably the at least one raise intersects the ore body to be caved. Thus, the preconditioning measures may be conducted in regions where the ore body is more competent than in other regions intended to be mined. The competent rock mass formation does not cave readily and easily due to its strength and caving may stall. The pre-conditioning measures creates a pre-conditioned zone which is characterized by artificial fractures inside the rock mass and/or by a decreased strength of natural discontinuities inside the rock mass. Accordingly, the strength of the rock mass in the pre-conditioned zone is reduced compared to its strength prior pre-conditioning.

Alternatively, pre-conditioning may be carried out by machinery arranged in a raise or a drift located outside the region intended to be mined. In one embodiment of the invention the mining method comprises performing pre-conditioning in at least some parts of the region intended to be mined.

In one embodiment of the invention, the method comprises operating the machinery arranged inside the raise for improving caveability and fragmentation of the rock mass foreseen to be a part of the stope.

In one embodiment of the invention, the method comprises performing pre-conditioning of rock mass from the raise in parallel with drawbell excavation. This means that these method steps may be performed at the same time. Alternatively, pre-conditioning may be conducted from the raise prior to drawbell development.

In one embodiment of the invention, the method comprises performing pre-conditioning of rock mass from the raise in parallel with undercutting. This is particularly advantageous in that the ramp-up time for development and production and can be shortened.

In one embodiment of the invention, the method comprises performing pre-conditioning in order to reduce the magnitude of mining-induced seismicity. This is very advantageous.

Preferably pre-conditioning and undercutting are then performed from the same raise and utilize same work processes namely machinery for drilling blast holes, charging and detonating explosive charges in those blast holes. Whilst undercutting is performed in a specific stope, pre-conditioning is conducted for the same stope at the same time. In another alternative pre-conditioning and undercutting may be alternated and performed at two different locations in a short period of time.

In one embodiment of the invention, the method comprises performing pre-conditioning of rock mass from inside the raise in parallel with caving of the caving stope below the raise. Then pre-conditioning and caving may be performed at two different locations in the stope at the same time. Alternatively, the method steps may be alternated and performed at two different locations in a short period of time. Due to pre-conditioning can the caving stope progress through the competent rock mass formation without stalling. As a result of the pre-conditioning measures applied from machinery operating inside the at least one raise, the caving progression rate and the possible production rate from the stope may be improved.

At least one monitoring system is installed in the integrated raise caving mining infrastructure. The monitoring system comprises amongst others a plurality of monitoring means, central monitoring unit, data collection units, communication devices and data analysis tools. A control system may also be installed. This control system utilizes the data and information generated by the monitoring system to control for example the machinery or production.

The at least on raise provides access into the drawbell and at later stage depending on the length of the raise the caving stope, the cave back and the rock mass above the cave back.

In one embodiment of the invention, the mining method comprises monitoring of caved rock mass by using a remote controlled monitoring device arranged inside the raise.

Monitoring means can be arranged inside the raise to monitor the mining operation, and the monitoring means can also be lowered through the raise into the cave which enables improved monitoring of for example cave back, fragmentation, fracturing zone etc. Monitoring means are for example seismic monitoring system, time domain reflectometry technology, open bore holes, cavity scanners, sensors, marker or geophones.

In one embodiment of the invention, the mining method comprises drilling boreholes into the rock mass from the raise and placing sensors in the boreholes. In addition, monitoring means can be installed in the rock mass such as markers or geophones by use of machinery operating inside the raise. This is advantageous as the raises provide improved accessibility to the rock mass of caving stopes being subsequently mined.

In one embodiment of the invention, the mining method comprises monitoring cave progression and/or direction of cave progression.

In one embodiment of the invention, the method comprises monitoring of the caving stope and/or the cave back and/or the caved rock masses by remote controlled monitoring means which is lowered through the raise and into the caving stope.

In one embodiment of the invention, the mining method comprises monitoring of an advancing fracture and loosening zone located above the cave back, and registering monitoring data thereof.

In one embodiment of the invention, the method comprises using monitoring data from cave monitoring for draw management of the rock mass material.

In one embodiment of the invention, the mining method comprises adjusting a draw strategy and/or draw control and/or caved rock masses at the production levels based on monitoring of the caving stope, the caved masses, and/or cave back.

The registered monitoring data may be used for controlling and adjusting a draw strategy at the production level(s) on demand and/or flexibly. A draw strategy is advantageous in that a formation of a large void can be avoided and/or in that extracted grades can be controlled and/or in that the dilution can be delayed.

Additionally, the raise(s) provide a better knowledge regarding the prevailing geology and rock mass conditions. Specifically, the position and extent of certain geological formations or zones of certain and/or similar rock mechanics behavior can be outlined.

Furthermore, monitoring and registered monitoring data allows improved understanding of the caving behavior and caveability of individual formations or zones.

In one embodiment of the invention, the method comprises controlling cave progression by performing controlling measures from inside the raise. In such a way the rate of cave progression can be controlled and influenced.

In one embodiment of the invention, the method comprises controlling the direction of cave progression by performing controlling measures from inside the raise. In such a way the direction of cave progression can be controlled and influenced.

In one embodiment of the invention, the method comprises controlling cave progression by operating machinery arranged inside the raise and/or by draw strategy and/or draw control.

In one embodiment of the invention, the method comprises controlling the direction of cave progression by operating machinery arranged inside the raise and/or by draw strategy and/or draw control.

In one embodiment of the invention, the method comprises controlling the direction of cave progression by pre-conditioning specifically selected volumes of rock mass.

Preferably cave progression may be controlled by performing pre-conditioning measures specifically in critical parts of the rock mass by operation of machinery located inside the raise and/or the applied draw strategy. Preferably, pre-conditioning measures are applied on demand.

In one embodiment of the invention, the mining method comprises determining of pre-condition measures based on monitoring of spatial distribution and/or behavior of individual formations and zones.

Based on the registered monitoring data, information regarding spatial distribution, behavior of formations, and behavior of zones, pre-conditioning measures can be applied from raises at a safe distance above the actual position of the cave back.

In one embodiment of the invention, the mining method comprises performing pre-conditioning measures during ongoing undercutting and/or ongoing caving. In such a way, there is no need to conduct the pre-conditioning before undercutting commences.

In case caving stalls, raises provide the possibility to observe the stalled area with remote controlled monitoring means. Thereby, the identification of the reasons of cave stall is facilitated. Additionally, where caving stalled, the raise provides an access for remote controlled or automated machinery into the cave back in the zone. In such a way cave stalling can be resolved by performing pre-breaking of the rock mass.

In one embodiment of the invention, the method comprises mitigating risk of air blast and/or cave stall in the stope by using monitoring means arranged inside the raise. Preferably a remote-controlled monitoring device is lowered through the raise into the cave to directly monitor a potential cave stall and/or air blast risk.

In one embodiment of the invention, the method comprises mitigating risk of air blast and/or cave stall in the stope by operating machinery arranged inside the raise and/or by draw strategy and/or by draw control.

In one embodiment of the invention, the mining method comprises that the at least one raise may also be used for performing pre-breaking measures. Thus, based upon the information from the monitoring means specific pre-breaking measures can be applied which aim for re-initiation of caving.

In one embodiment of the invention, the method comprises re-initiation of the caving by operating the machinery arranged inside the raise in case caving stalled. Preferably, re-initiation is performed by drilling and blasting of the cave back.

In one embodiment of the invention, the mining method comprises that the cave progression direction is non-vertical. The cave progression direction depends on several parameters which are, amongst others, the prevailing rock mass properties, their spatial distribution, the prevailing stress situation, the presence of large faults or shear zones, the presence of previously mined stopes, and the implemented draw strategy.

Different methods may be applied to control the direction of cave progression such as pre-conditioning, pre-breaking, and/or draw strategies can be used to control the direction of cave progression.

In one embodiment of the invention, the mining method comprises controlling the direction of cave progression.

In one embodiment, the draw strategy may be adapted in order to direct the cave progression in a preferred direction.

In one embodiment of the invention, the mining method comprises controlling the direction of cave progression by pre-conditioning specifically selected volumes of rock mass. In particular, pre-conditioning measures may be applied to control the direction of cave progression near a weak rock mass formation and/or large faults and/or shear zones.

Overall, the application of raises provides a better controllability and thereby improves the operation. Moreover, the integrated raise caving mining method may thus be applied to more difficult mining environments for caving operations. Such mining environments comprise for example deep ore bodies, competent rock masses, or geometrically constrained ore bodies.

In one embodiment of the invention, the method comprises that a mining sequence is adapted to and determined by production and/or ore body geometry and/or rock mechanics consideration and/or ore flow considerations. The mining sequence determines the order of mining activities which should be followed to achieve the overall goals of mineral extraction of the ore body. The goals are an as complete extraction as possible, the safety and economy of the mining operation considering rock mechanical constraints, and other factors.

In one embodiment of the invention, the method comprises that the mine layout and infrastructure position are adapted to and determined by production and/or ore body geometry and/or rock mechanics consideration and/or ore flow considerations.

In one embodiment of the invention, the method comprises that the mine layout and/or infrastructure position and/or mining sequence are adjusted on short notice. In such case unforeseen circumstances can be taken into account.

In one embodiment of the invention, the method comprises performing parallel infrastructure development and production ramp-up. This is advantageous in that mining layout and sequence of the integrated mining method allow that production can be ramped-up simultaneously with the infrastructure development. This is cost efficient and shortens the time until production.

In one embodiment of the invention, the method comprises that after caving reached the ore body boundaries, waste rock mass from the surrounding and/or overlying rock mass formations caves into the stope.

In one embodiment of the invention, the method comprises that in the process of drawing remaining ore from the stope, the stope is subsequently filled with waste rock mass.

In one embodiment of the invention, the method comprises connecting the caving stope to a formerly mined out area. Alternatively, the caving stope may be connected to the surface which causes subsidence.

From a rock mechanics point of view, the development of a drawbell from at least one raise and the associated undercutting is particularly advantageous. The required infrastructure for drawbell development and undercutting is limited. Moreover, infrastructure required for undercutting may be situated in a more favorable stress environment. Accordingly, possible damage to infrastructure can be limited. Moreover, personnel does not need to work in high stress zones. As the drilling, charging and blasting work in the raise can easily be remote controlled, or automated, workforce may be removed from hazardous areas completely.

Another rock mechanics advantage is the improved strength of production level(s). The presence of the large drawbell and the arrangement of drawpoints on several levels enable the creation of large pillars with considerable strength between neighboring drifts and drawpoints. Moreover, due to the development of most of the production level infrastructure after drawbell construction and undercutting, production level infrastructure is developed delayed and corresponding pillars are not exposed to high stresses during undercutting. Therefore, rock mass damage can be reduced, and stability be increased.

Overall, the integrated raise caving mining method offers significant advantages from a rock mechanics point of view. These advantages manifest themselves in an improved safety, a reduced risk and an improved stability.

In one embodiment of the invention, the method comprises that the stope generates a stress-shadow at certain locations adjacent to the stope, wherein said stress-shadow de-stresses the rock mass thereby creating a favorable stress environment.

In one embodiment of the invention, the method comprises that the interaction between at least two adjacent stopes generate a regional favorable stress environment for mining infrastructure.

In one embodiment of the invention, the method comprises that raises, drifts, drawpoints and other infrastructure are developed in a favorable stress environment at locations adjacent to drawbells and/or stopes.

In one embodiment of the invention, the method comprises repeating the steps of the method to a larger area.

These or at least one of said objects are achieved by use of the integrated raise caving mining method for mining of ore from a deposit where cave mining methods such as block caving, panel caving, inclined caving, or raise caving are applied according to some embodiments of the present disclosure.

Certain elements of the integrated raise caving mining method according to the invention could be applied in prior art caving methods. For example, neighboring stopes mined by raises could replace a traditional flat undercut in block and panel caving. In such way, the size of the stope roof would be increased, until caving is initiated. Moreover, raises equipped with appropriate machinery above an active cave would provide possibilities for pre-conditioning, cave advance monitoring, facilitation of cave advance and control of caving front.

These or at least one of said objects are achieved by an integrated raise caving mining infrastructure configured for mining deposits in a rock mass according to some embodiments of the present disclosure, wherein further embodiments are incorporated in the dependent claim.

Hence, according to one aspect the present invention relates to an integrated raise caving mining infrastructure that comprises: at least one raise developed in the rock mass; a drawbell developed in the rock mass, wherein at least a portion of the drawbell is joined to the at least one raise; an undercut being configured to initiate caving of rock mass located above the undercut, wherein at least a portion of the undercut is formed as a part of the drawbell; wherein said portion has been created by gradually expanding the drawbell in upward direction by excavation; at least two drawpoints joined to the drawbell, wherein the drawpoints are joined to drifts arranged on different levels; and a transport device configured to progressively draw fragmented rock from the drawbell.

Alternatively, the integrated cave mining infrastructure comprises a caving stope located above the drawbell.

It should be noted that more than one integrated raise caving mining infrastructures may be present in the same active mining area.

These or at least one of said objects are achieved by a monitoring system according to some embodiments of the present disclosure, wherein further embodiments are incorporated in the dependent claims.

Hence, according to one aspect the present invention relates to a monitoring system configured for monitoring an integrated raise caving mining infrastructure configured for mining deposits in rock mass, which monitoring system comprises monitoring means configured for monitoring development of at least one raise developed in the rock mass; and/or monitoring means configured for monitoring development of a drawbell developed in the rock mass, wherein at least a portion of the drawbell is joined to the at least one raise; monitoring means configured for monitoring development of an undercut being configured to initiate caving of rock mass located above the undercut, wherein at least a portion of the undercut is formed as a part of the drawbell; wherein said portion has been created by gradually expanding the drawbell in upwards direction by excavation; and/or monitoring means configured for monitoring development of at least two drawpoints joined to the drawbell, wherein the drawpoints are joined to drifts arranged on different levels; and/or monitoring means configured for monitoring the initiation of caving of the rock mass; and/or monitoring means configured for monitoring of a transport device configured to progressively draw fragmented rock from the drawbell; and/or monitoring means configured for monitoring the rock mass in the active area; and/or monitoring means configured for monitoring the caving stope Alternatively, the monitoring system is configured for monitoring cave progression and/or direction of cave progression. Alternatively, the monitoring system is configured for monitoring of caved rock mass by using a remote controlled monitoring device arranged inside the raise.

Alternatively, the monitoring system is configured for remotely monitoring of the caving stope and/or the cave back and/or the caved rock masses. Alternatively, the monitoring system is configured for monitoring an advancing fracture and loosening zone located above the cave back. Alternatively, the monitoring system is configured for monitoring seismicity and/or stress and/or deformations in the rock mass wherein the integrated raise caving mining infrastructure is located. Alternatively, the monitoring system is configured for collecting monitoring data, analysing monitoring data, storing monitoring data and/or transmitting monitoring data via wireless and/or wired communication means to an automatic or semi-automatic control system of an integrated raise caving mining infrastructure.

The monitoring system comprises amongst others a plurality of monitoring means, a central monitoring unit, data collection units, data storage means, communication devices for wireless communication of signals and monitoring data and/or data analysis tools. The monitoring system is configured to communicate with the automatic or semi-automatic control system and transmits data and information generated by the monitoring system to the automatic or semi-automatic control system. The monitoring means comprises for example seismic monitoring system, time domain reflectometry technology, open bore holes, cavity scanners, sensors, marker or geophones.

These or at least one of said objects are achieved by a machinery according to some embodiments of the present disclosure, wherein further embodiments are incorporated in the dependent claims.

Hence, according to one aspect the present invention relates to a machinery comprising a drilling and/or charging device configured for; developing at least one raise in the rock mass; and/or developing a drawbell in the rock mass, wherein at least a portion of the drawbell is excavated from the raise by drilling and/or charging by means of the machinery, thereby initiating caving through undercutting;

developing the drawbell by gradually expanding the drawbell in upwards direction by excavation; and/or developing at least two drawpoints into the drawbell, wherein the drawpoints are developed from drifts arranged on different levels; and/or transporting fragmented rock from the drawbell through the drawpoints.

Alternatively, the machinery is configured for drilling and/or charging the rock mass from inside the raise. Alternatively, the drilling and/or charging device comprises a drilling bore and/or charging equipment configured for initiating said caving. Alternatively, the machinery comprises pre-conditioning equipment. Alternatively, the machinery comprises that the drilling and/or charging device is arranged on a movable platform, which is movable within the raise for reaching a position for operation of the drilling and/or charging device.

Alternatively, the machinery comprises that the platform is configured with a modular design. Alternatively the machinery and/or equipment arranged on the platform is configured with a modular design. Alternatively, the machinery comprises that the platform is configured to be moved to the side at the top of the raise to be stored in a storage position.

Alternatively, the machinery is configured for installing rock support from inside the raise, such as rock bolts, mesh, shotcrete or cable bolts. Alternatively, the machinery is configured for hydrofracturing the rock mass from inside the raise. Alternatively, the machinery is configured for performing directional drilling. Alternatively, the machinery is configured for drilling curved boreholes by directional drilling. Alternatively, the machinery is configured for blast initiation of the charged boreholes. Alternatively, the machinery is configured for for blast initiation from inside the raise. Alternatively, the machinery is configured for blast initiation by wired detonators and/or remote-controlled detonators and/or non-electric detonators and/or wireless detonators. Alternatively, the machinery is configured for loading and transporting fragmented rock from the drawpoints by loaders and/or trucks and/or continuous draw machinery with conveyours. Alternatively, the machinery is configured to be operated by remote control and/or by manual control. Alternatively, the machinery is configured for semiautomation or full automation.

Alternatively, the integrated raise caving mining infrastructure comprises the machinery according to some embodiments.

Alternatively, the integrated raise caving mining infrastructure comprises the monitoring system according to some embodiments.

These or at least one of said objects are achieved by an automatic or semi-automatic control system accord to some embodiments of the present disclosure, wherein further embodiments are incorporated in the dependent claims.

Hence, according to one aspect the present invention relates to an automatic or semi-automatic control system of an integrated raise caving mining infrastructure according to some embodiments, wherein the automatic or semi-automatic control system is electrically coupled to a control circuitry configured to control the method according to some embodiments.

Alternatively, the automatic or semi-automatic control system comprises said machinery according to some embodiments, wherein the machinery is configured to be operated by the automatic or semi-automatic control system in remote control mode and/or in automatic control mode and/or in semi-automatic control mode and/or manually controlled mode.

Alternatively the automatic or semi-automatic control system comprises the monitoring according to some embodiments, wherein the monitoring system is configured to communicate with and be operated by the automatic or semi-automatic control system in remote control mode and/or in automatic control mode and/or in semi-automatic control mode and/or manually controlled mode.

Alternatively the integrated raise caving mining infrastructure comprises the automatic or semi automatic control system according to some embodiments.

These or at least one of said objects are achieved by a data medium according to some embodiments of the present disclosure, wherein further embodiments are incorporated in the dependent claims.

Hence, according to one aspect the present invention relates to a data medium, configured for storing a data program, configured for controlling the automatic or semi-automatic control system according to some embodiments and/or configured for controlling the machinery according to some embodiments, said data medium comprises a program code readable by the control circuitry for performing the method according to some embodiments when the data medium is run on the control circuitry. Overall, the integrated raise caving mining method and the raise caving mining infrastructure, the machinery, the monitoring system, the the automatic or semi-automatic control system and the data medium offers significant advantages from a rock mechanics point of view. These advantages manifest themselves in an improved safety, a reduced risk, and an improved stability. The integrated raise caving mining method and the raise caving mining infrastructure, the machinery, the monitoring system, the the automatic or semi-automatic control system and the data medium according to the invention offers considerable flexibility. The amount of infrastructure required for development of a caving stope and ramp-up of production is reduced. The combined use and sharing of infrastructure for the implementation of undercutting, production (caving), and preconditioning enables the latter circumstance. The remaining portions of the infrastructure can be developed after drawbell development and undercutting are completed. The limited amount of infrastructure pre-development enables to decide on the position of subsequent drawbells, raises, drawpoints etc. on short notice, which contributes to the flexibility of the integrated raise caving mining method significantly. Moreover, the position, size, shape, and orientation of drawbells, drawpoints, raises, and other infrastructure can be adapted to local conditions and/or requirements.

Overall, the flexibility of the integrated raise caving mining method and the raise caving mining infrastructure, the machinery, the monitoring system, the the automatic or semi-automatic control system and the data medium offers considerable improvements. The mine layout and mining sequence can be adopted to the prevailing mining environment, which comprises amongst others the prevailing stress situation, the prevailing rock mass formations, and the ore body shape on short notice. Thereby, the integrated raise caving mining method and the raise caving mining infrastructure, the machinery, the monitoring system, the the automatic or semi-automatic control system and the data medium enables the avoidance of critical situations and the relatively easy adaption to unforeseen circumstances. Moreover, possibly available favorable stress environments which are provided by caving stopes may be used for protection of infrastructure. In summary, the available flexibility contributes to the reduction of risks considerably.

Above outlined technical advantages achieved by the integrated raise caving mining method, the raise caving mining infrastructure, the machinery, the monitoring system, the the automatic or semi-automatic control system and the data medium according to the present invention may result in some or all of the following overall improvements compared to prior art caving methods.

Improved Efficiency

- removes the spatial and temporal dependency of undercut and production level enables shorter ramp-up time because of integrated cave development
- reduces requirement for infrastructure pre-development
- enables delayed development of production infrastructure
- increases automation and remote-control potential
- provides less infrastructure exposure to highly stressed rock mass
- provides less workforce exposure to highly stressed areas
- improves infrastructure stability
- requires lower support and rehabilitation demand
- improves functionality of the undercut
- improves drawpoint arrangement and thus ore flow
- provides a lower risk of hang-ups and better ability to clear hang-ups Improved flexibility
- enables easier adaption to local mining environment
- enables easier adaption to ongoing mining experience
- enables on demand pre-conditioning and pre-breaking
- enables on demand and scheduled switching from caving to drilling and blasting inside stopes for a short period of time
- provides improved access above caving stope Improved Controllability

- enables better and more efficient draw strategy and control (dilution, recovery etc.)
- enables improved monitoring (cave back, fragmentation, fracturing zone etc.)
- enables improved control of cave progression and direction
- enables cave mining of geometrically constrained and/or highly competent ore bodies
- provides accessibility to the stopes (reduced risk for air blast, cave stall etc.)

In conclusion, these improvements facilitate the goals of mineral extraction, which are a safe, as complete as possible, and profitable extraction. In some instances, this will also enable the extraction of mineral deposits by a caving method, which cannot be mined by a prior art caving method.

In this specification the following terms and expressions are defined as below and are used accordingly.

The term "ore" refers to a mineral aggregate of sufficient value as to quality and quantity to be mined at a profit. The prevailing definition of ore does not only comprise metal ore, but any other mineral aggregates, for example industrial minerals etc.

The term "ore body" refers to a volume of rock mass containing ore. In this specification the term "deposit" is used synonymously for ore body.

The term "stope" refers to the part of the ore body, from which ore is currently being mined or broken by stoping. The term "stoping" includes all operations of breaking rock or mineral for example by drilling and blasting, mechanical excavation and/or caving, and extracting rock or mineral in stopes, after breaking.

The term "caving stope" refers to a stope, which is excavated by means of caving. The term "cave" is used synonymously for the term caving stope.

The term "undercut" refers to a void created in the rock mass with the objective of cave initiation. The term "undercutting" refers to removal of a section or kerf in a rock mass to initiate caving subsequently.

"Active mining areas" are areas of significant and ongoing stress changes resulting from mining activities in the area. These are predominately but not exclusively the extraction (stoping) areas. The heading of tunnels under development are also active areas but on a localized scale. Active mining areas require ongoing supervision, monitoring of ground conditions and attention to excavation support. As mining advances active areas change to passive areas which require reduced levels of supervision and monitoring except for main transport and regularly used infrastructure excavations.

The expression "mining sequence" refers to the sequence of mining activities which should be followed to achieve the overall goals of extraction of the ore body as complete as possible, the safety and economy of the mining operation, considering operational factors, rock mechanical constraints, and other factors.

The expression "favourable stress environment" refers to a stress state which is controllable and which does not require extensive and expensive support measures for subsequent operation in the respective mining area. A favourable stress environment could be either a de-stressed area in a rock mass, or an abutment area where abutment stresses are limited or restricted to a controllable magnitude. The favourable stress environment serves the purpose to create a favourable environment for the subsequently establishment of raises and the subsequent operation in the production stopes and where possible mine infrastructure with a long lifetime. The term "favourable stress situation" is used synonymously. From the above follows that the term "de-stressing" refers to the process of creating a de-stressed environment in the rock mass i.e. a stress-shadow.

The term "stress-shadow" refers to a part of the rock mass where the stress is reduced in at least one direction in comparison with the pre-mining rock stress in corresponding direction in the same part of the rock mass.

The term "raise" refers to a longitudinally extended vertical or inclined mine infrastructure opening.

The term "rock pass" refers to steeply inclined passageways used for the transfer of material in underground mine workings. Rock passes are designed to utilize the gravitation potential between levels to minimize haulage distances and facilitate a more convenient material handling system. The term "ore pass" refers to rock passes that are solely used for the transport of ore. In deep mines it is common practice to gravitate the ore to the deepest level in the mine from where it is hoisted to surface.

The terms "tunnel" and "drift" are herein used as synonyms and refer to same type of infrastructure.

The term "pre-conditioning" refers to a technique to increase the in-situ fragmentation of the rock mass so that it will cave or fragment more readily.

The term "pre-break" refers to a technique which may be specifically used in a competent zone to re-initiate caving to progress through this zone with the stope.

The term "dilution" refers to a contamination or mixing of worthless rock mass with ore.

The term "drawpoint" refers to an excavated structure through which the caved or broken rock mass is removed from the stope and/or drawbell.

The term "drawbell" refers to an excavated structure which channels caved or broken rock mass to at least one drawpoint.

The term "draw zone" refers to the zone of caved or broken rock mass that will eventually report to a particular drawpoint during progressive draw. The "isolated draw zone" refers to the draw zone isolated from other draw zones as a result of drawing from an isolated drawpoint. The "interactive draw zone" refers to the zone in-between isolated draw zones which are drawn concurrently such that the rock mass flows towards drawpoints and leads to an enlargement of isolated draw zones. The advantage with an "interactive draw zone" is that the ore losses are reduced compared to isolated draw zones. The broken ore in adjacent draw zones may migrate from one draw zone to the other.

The term "mass flow" refers to the mechanism by which a volume of broken or caved rock mass moves downwards uniformly during draw. The presence of interactive draw further fosters mass flow. Thereby the risk for dilution is reduced.

Caving operations require a "draw strategy" in which the draw is spatially and temporally planned for the given drawpoints. This process needs to be controlled operationally and may be referred to as "draw control" for which the amount and properties of ore drawn from individual drawpoints are registered. The observations from draw control can in turn be used again to adapt the applied draw strategy.

It should be noted that the the expressions "flow of ore", "material flow", "flow of fragmented rock" is used synonymously in this specification.

Additional objects, advantages, and novel features of the present invention will become apparent to one skilled in the art from the following details and through exercising the invention. Whereas examples of the invention are described below, it should be noted that the invention may not be restricted to the specific details described.

BRIEF DESCRIPTION OF THE DRAWINGS

To fully understand the present invention and further objects and advantages of it, the detailed description set out below should be read together with the accompanying drawings, in which the same references denote similar features in the various figures, and in which:

FIG. 1*a* illustrates a platform lowered into a raise for drilling and charging activities, FIG. 1*b* illustrates the platform stored at top in hoist frame for blasting, FIG. 1*c* illustrates excavation after blasting with void filled due to swell of blasted rock mass.

FIGS. 4*a*-4*c* schematically illustrate a vertical cross-section of one example of enlarging of a caving stope in lateral direction according to the invention.

FIG. 11*a*-11*e* schematically illustrate isometric views of one example of an implementation of the method according to the invention.

DETAILED DESCRIPTION OF EMBODIMENTS AND EXAMPLES OF THE INVENTION

Examples and embodiments of the integrated raise caving mining method, the mine layout, and the mining sequence according to the present invention, will be described in the following with references to the figures.

For purpose of simplicity the rock mass is not shown in the figures but rather the raises, drawbells and drawpoints developed in the rock mass.

One important feature of the integrated raise caving mining method is the development of at least one drawbell from at least one raise and its successive transition to a caving process above the drawbell.

Figure 1C:
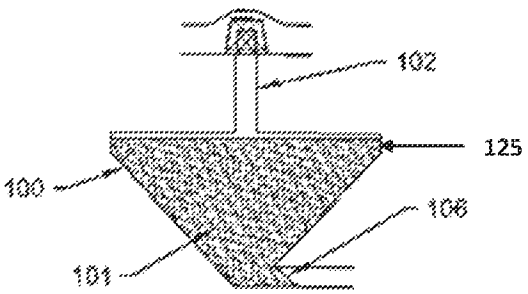
FIGS. 1*a-c* schematically illustrate in a vertical cross-section the basic principle of drawbell development according to the invention.
Figure 1B:
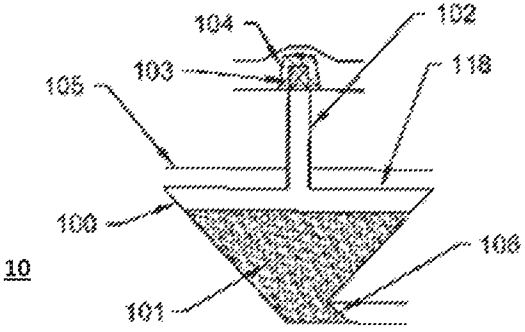
Figure 1A:
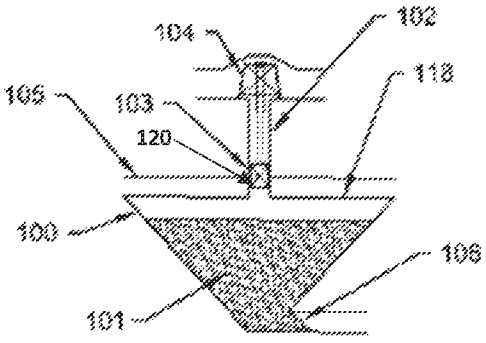

FIG. 1*a*-1*c* schematically illustrate a vertical cross-section of a principle of drawbell development in a rock mass, herein also referred to as drawbell excavation, from a raise with mining equipment located inside the raise. FIG. 1*a* illustrates schematically the development of a drawbell 100 by drilling and charging carried out from the mining equipment, machinery 120, positioned on a platform 103, which is moved with a shaft hoist system 104 inside a raise 102. The platform 103 must be designed such that it can still be moved inside the raise 102, even in the case of rock mass deformations occurring in the raise.

The shaft hoist system 104 is located in a specifically excavated infrastructure excavation, which size and shape is adapted to the requirements of the hoist system and/or rock mechanics considerations. In order to keep the infrastructure excavation of the hoist system 104 small, a modular design of the platform 103 and/or machinery 120 mounted on the platform is advantageous. A small infrastructure excavation provides an improved stability. The modular design allows changing of utilized machinery quickly.

The machinery 120 mounted onto the platform 103 is adapted to operational requirements. Possible types of machinery comprise amongst others machinery for drilling, machinery for charging, machinery for support installation or machinery for hydraulic fracturing.

As shown in FIG. 1*a*, a raise 102 has already been developed from a drift in rock mass 10 by conventional techniques. The platform 103 and hoist system 104 are installed after development of the raise 102 is finished. The drawbell is gradually expanded in upwards direction by excavation such that a drawbell roof area becomes larger than a drawbell bottom area. The drawbell 100 is blasted in subsequent near horizontal slices of rock mass in upwards direction. The length, orientation, and inclination of drill holes 105 are adapted such that the shape of individual blast slices is adapted such that a drawbell of a specific predetermined shape can be formed. Drill holes may be drilled horizontally or inclined downwards or upwards. Downward inclined drill holes may achieve a better toe breakage. The drill holes 105 are drilled at a specific distance from an existing drawbell roof 118. After drill holes 105 are drilled and charged with explosives, the platform 103 is retracted to the top and stored in a safe position so that damage to the platform 103 resulting from blasting is avoided. FIG. 1*b* outlines the retracted and stored platform 103.

In another form of the invention, the platform 103 may also be stored by moving it aside from the top of the raise 102. Thus the platform is configured to be moved to the side at the top of the raise to be stored in a storage position.

The blast initiation can be carried out with different options, which comprise amongst others non-electric detonators, detonators initiated through an electric signal transferred via cable or detonators initiated wirelessly by means of communication through rock mass.

In another form of the invention, more than one slice could be blasted in a single blast. Thereby an appropriate time delay between individual slices is required.

FIG. 1*c* illustrates schematically that broken rock mass 101 falls into the drawbell 100 due to blasting, and that there must be enough void to absorb the swell of fragmented rock resulting from blasting. Before the next blast holes can be fired, enough broken rock mass must be drawn from the drawbell accordingly. Broken rock mass 101 is drawn through drawpoint 106. Either one or several drawpoints may be used to draw the broken rock mass 101 from the drawbell 100. However, only the swell is drawn out of the drawbell so that the formation of an excessively large void is avoided.

FIG. 1*c* further shows that drawbell 100 is expanded in the upwards direction without increasing the length of the perimeter of the drawbell roof such that the drawbell obtains a section 125 provided with a horizontal cross-section having constant or nearly constant area in upwards direction. Such section may for example serve as location for developing a drawpoint into the drawbell.

In the attached figures it should be noted that the shape of the drawbells and caving stopes are only schematic illustrations which are very much idealized for the purpose of simplification.

Furthermore, features like excavations, main infrastructure, hoist shafts, ore handling facility etc. which are required in all mining methods, are not shown.

FIG. 2*a*-2*d* schematically illustrate a vertical cross-section of one example of initiation of caving resulting from drawbell development according to the invention.

Figure 2D:
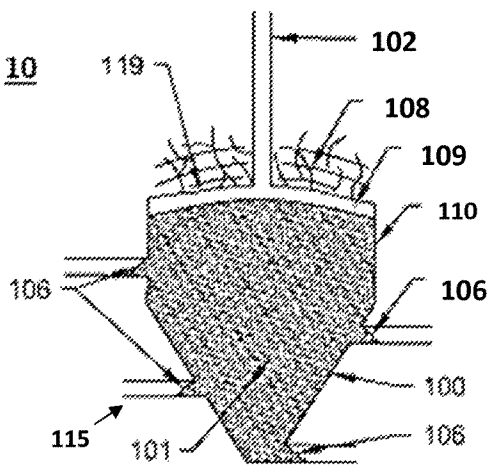
FIGS. 2*a*-2*d* schematically illustrate a vertical cross-section of one example of initiation of caving resulting from drawbell development as shown in FIGS. 1*a*-1*c* according to the invention.
Figure 2C:
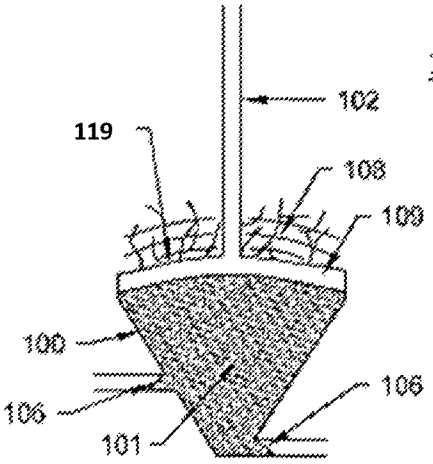
Figure 2B:
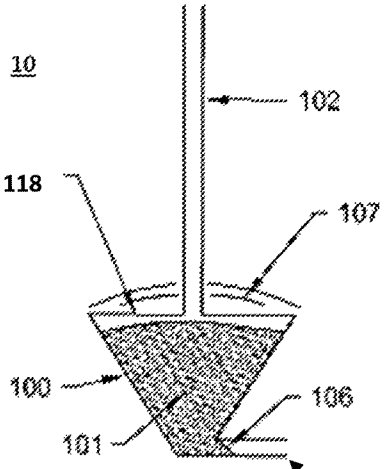
Figure 2A:
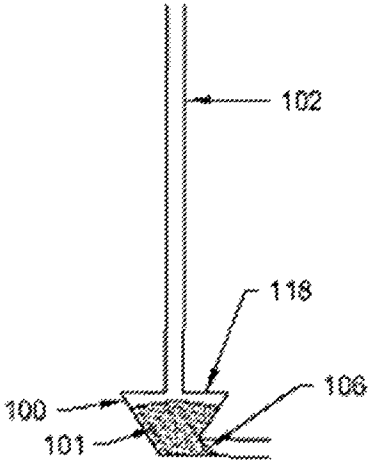

FIG. 2*a* shows a drawbell 100, which is developed in rock mass 10 by excavation by drilling blast holes into the rock mass around the raise by operating a machinery 120 arranged on a platform (machinery and platform is not shown in figure) arranged inside the raise. The blast holes are charged by the machinery 120 and thereafter the rock mass is blasted by detonating explosives in those blast holes such that a portion of the draw bell is blasted. Excavation of the portion of the drawbell is performed by blasting slices of rock mass. Fragmented rock mass 101 is drawn at drawpoint 106 out of the drawbell 100. As drilling and blasting continues upwards, the shape of individual blast slices is adapted to form a drawbell 100 of specific shape. Local rock mass conditions, stress situation, ore flow considerations, as well as production demands influence its shape. Moreover, the area of the roof 118 of the drawbell 100 is gradually increased during drawbell development by means of drilling and blasting. FIG. 2*b* illustrates the increased drawbell roof area 118 in comparison with FIG. 2*a*. Additionally the gradual increase of the drawbell roof area is part of the undercutting process. At least a part of an undercut is created through gradually expanding the drawbell in upwards direction by excavation and increasing the roof area of the drawbell. This undercutting process initiates caving in the rock mass, after the area of the undercut rock mass exceeds a critical area. The critical area required for cave initiation is a function of rock mass properties, stress situation and the shape of the undercut area. FIG. 2*b* shows a drawbell 100, in which the drawbell roof area, which corresponds to the undercut area in the provided example, has not exceeded the critical area required for cave initiation yet. However, first fractures 107 developed and/or discontinuities opened above the roof of the drawbell 100. Therefore, rock mass within the region of fractures 107 enters a yield state and rock mass properties deteriorate subsequently. The drill and blast design may be adjusted in this phase to adapt to the additional requirements caused by the yielding rock mass.

In FIG. 2*c* the roof area of the drawbell 100 has increased and exceeded the critical area required for cave initiation. Thus, caving process was initiated and progresses upwards. The rock mass located above the drawbell caves and a caving stope having a zone of fractured rock mass above the caving stope 108 forms. This zone of fractured rock mass 108 is characterized by development of fractures and/or opening of discontinuities in the rock mass. The prevailing rock mass properties, stress conditions, and mine layout influence the extent and degree of fracturing inside the zone of fractured rock mass 108 significantly. The rock mass yields in the zone of fractured rock mass 108, finally detaches, and falls as broken rock mass 101 into the drawbell 100. The drawbell is provided with at least two drawpoints 106, which are developed on two different levels into the drawbell. Broken rock mass 101 is drawn from the drawbell through the drawpoints 106.

Consequently, a void 109 is created above the broken rock mass 101. This void 109 is required for cave progression. Rock mass from the zone of fractured rock mass 108 detaches and falls into the void. Broken rock mass 101 is finer than the in-situ rock mass and/or rock mass in the fractured zone 108. Moreover, further comminution processes occur in the broken rock mass 101 which reduces particle size as broken rock mass flows towards the drawpoints 106.

Preferably, the drawbell 100 is configured to be oriented such that the infrastructure is positioned favorably related to the prevailing stress situation. However, in another alternative, the drawbell 100 is configured to be oriented such that cave initiation is facilitated by the prevailing stress situation.

FIG. 2*c* outlines one possible caving mechanisms. The shown caving mechanism is driven by stresses and a zone of fractured rock mass forms therefore above the caving stope. However, other caving mechanism may be active as well. Caving mechanisms may also occur in combination.

FIG. 2*d* illustrates that caving has progressed further upwards and thereby formed a stope 110 above the drawbell 100. The drawbell has been provided with tunnels on additional levels arranged on opposite sides of the drawbell. The additional levels are elevated above the bottom of the drawbell. Each level provides additional drawpoints 106 which are developed into the drawbell 100. Subsequent drawing of ore from the stope 110 through the drawbell 100 at drawpoints 106 increases the size of the void 109. To achieve a continuous caving process and for reasons of ore flow optimization the position of drawpoints 106 is critical. Thus, additional drawpoints 106 have been developed into the drawbell 100 and into the stope 110 above the drawbell to stimulate material flow in the drawbell and the caving stope. As shown, the additional drawpoints are developed from different directions into the drawbell, in this case on opposite sides of the drawbell. A sufficiently large void 109 must be formed below the stope roof, which corresponds to the cave back 119, so that further rock mass can detach from the zone of fractured rock mass 108. The zone of fractured rock mass 108 is now situated above the roof of the stope 110. However, the void 109 must also be kept to reasonable size to avoid the risk of an air blast. The size of the void 109, the broken rock mass 101 and/or the zone of fractured rock mass may be monitored using the raise 102. Also, the cave progression and/or direction of cave progression and the caving stope and/or the cave back 119 may be monitored by monitoring means arranged inside the raise. The monitoring means may also be lowered through the raise into the caving stope which is advantageous. Due to continued draw of broken rock mass from the stope the cave continues to progress upwards. After caving reached the ore body boundaries, waste rock mass from the surrounding and/or overlying rock mass formations starts caving into the stope. In the process of drawing the remaining ore from the stope, the stope is subsequently filled with waste rock mass.

In another embodiment of the invention, a caving stope may also be connected to a formerly mined out area or to the surface, which causes subsidence.

FIG. 3*a*-3*d* schematically illustrate in a vertical cross-section one example of initiation of caving resulting from development of more than one drawbell.

Figures 3A, 3B, 3C, 3D:
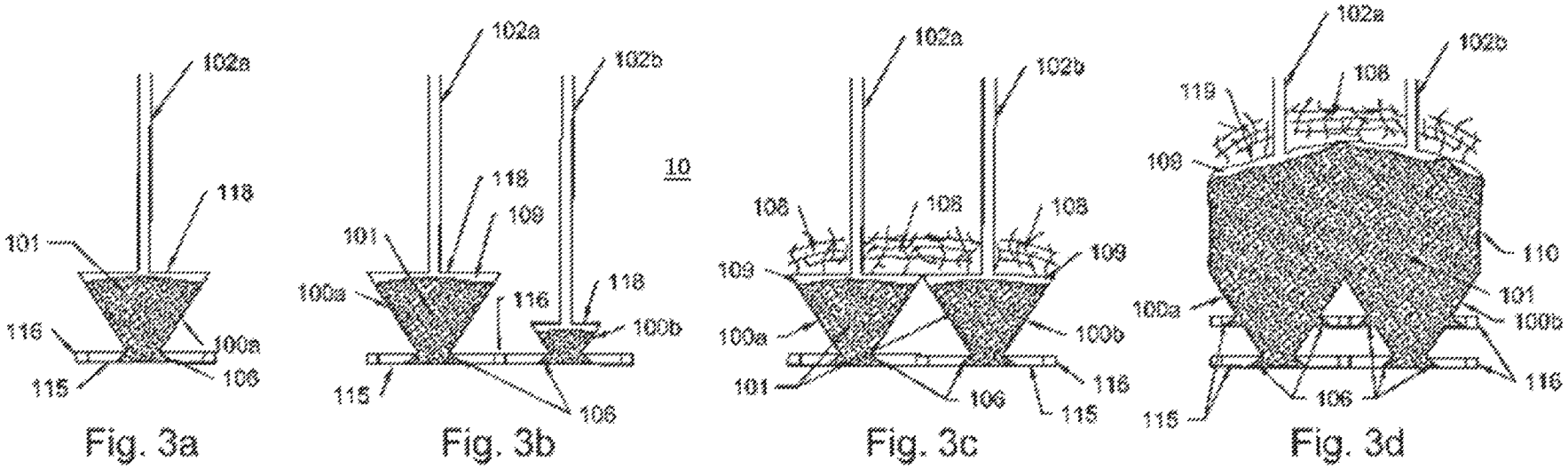
FIGS. 3*a*-3*d* schematically illustrate a vertical cross-section of one example of initiation of caving resulting from development of more than one drawbell according to the invention.

FIG. 3*a* shows a developed drawbell 100*a* in rock mass 10. Machinery 120 (machinery not shown in figure) operating inside a raise 102*a* is used for development of drawbell 100*a*, which is filled with broken rock mass 101. Caving did not start above drawbell 100*a*.

FIG. 3*b* illustrates the development of a second drawbell 100*b* from raise 102*b*.

In FIG. 3*c* drawbell 100*b* is fully developed. Drawbells 100*a* and 100*b* are developed adjacent to each other. Drawbells 100*a,b* are used for undercutting. At least a part of an undercut is created through gradually expanding of the drawbells upwards in the vertical direction. The drawbells are excavated in height and width. The roofs of drawbells 100*a,b* are joined in order to form a large unsupported area, an undercut, which is larger than the critical area required for cave initiation. Consequently, a zone of fractured rock mass 108 forms above the roof of drawbells 100*a,b* and caving is initiated through undercutting. Rock mass detaches from the zone of fractured rock mass 108 and falls onto the broken rock mass 101, which is located in drawbells 100*a,b*. A void 109 must be present below the zone of fractured rock mass 108 to allow detachment of rock mass from the zone of fractured rock mass 108 and subsequent cave progression. Broken rock mass 101 is drawn at drawpoints 106 from drawbells 100*a,b*. Drifts 115,116 are oriented in different directions and provide access to drawpoints 106.

FIG. 3*d* shows the subsequent cave progression following cave initiation, which is outlined in FIG. 3*c*.

In FIG. 3*d* caving progressed in upwards direction and thereby forms a coherent stope 110, which is located above drawbells 100*a* and 100*b*. To enable cave progression, broken rock mass is drawn at drawpoints 106 developed into drawbells 100*a,b*. Drifts 115,116 are oriented in different directions and provide access to drawpoints 106. Thereby a void 109 is formed on top of the broken rock mass 101 in the stope 110 below the cave back 119. Thus, rock mass can detach from the zone of fractured rock mass 108 and can fall into the stope 110; and caving progresses in an upwards direction. Raises 102*a,b* may be used for monitoring purposes or cave inducement measures, for example different methods of pre-conditioning, or pre-breaking.

FIG. 4*a*-4*c* schematically illustrate a vertical cross-section of one example of enlarging of the caving stope in lateral direction by means of developing of an additional drawbell next to the caving stope.

FIG. 4*a* shows a caving stope 110, which is filled with broken rock mass 101 and which has two drawbells 100*a* and 100*b*. Caving is progressing in upwards direction due to subsequent draw of broken rock mass through drawpoints 106 developed into drawbells 100*a,b* and due to subsequent detachment of rock mass 10 falling into the void 109 from the zone of fractured rock mass 108. Drifts 115,116 are oriented in different directions, and provide access to drawpoints 106. Depending on availability, all drawpoints 106 are in operation to facilitate drawing of rock mass from the drawbells. To increase the lateral extension of the stope 110 a drawbell 100*c* is developed next to the stope 110 by means of drilling and blasting conducted with machinery 120 (not shown in figure) operating in raise 102*c*. In FIG. 4*a* development has started of drawbell 100*c*.

In FIG. 4*b* drawbell 100*c* is fully developed. Caving is initiated above drawbell 100*c* and a zone of fractured rock mass 108 forms above drawbell 100*c* accordingly. Moreover, drawbell 100*c* is connected to the adjacent drawbell 100*b*.

FIG. 4*c* shows a more advanced stage of cave progression. The existing undercut established from drawbell 100*a,b* is widened in lateral direction as drawbell 100*c* is joined to the caving stope. Caving progresses in vertical direction above drawbells 100*a,b,c*, due to continuing draw of broken rock mass 101 at drawpoints 106. Drifts 115,116 are oriented in different directions and provide access to drawpoints 106. As drawbells 100*a,b,c* are adjacent and connected, the coherent stope 110 forms above drawbells 100*a,b,c*. Raises 102*a,b,c* may be used for monitoring or cave inducement measures.

As drawing of rock mass through drawbells continues, caving progresses into the waste rock mass, which starts to fill up the stope. Drawpoints and the corresponding drawbell are put out of operation and abandoned, after an unacceptable content of waste rock mass reports to the drawpoint. Accordingly, the affected drawbell is said to be depleted.

In another embodiment of the invention, adjacent drawbells may be configured such that they are of different shape and/or size and/or such that they are situated at different elevations.

The direction of cave progression as shown in FIGS. 2*c*,2*d*,3*c*,3*d*,4*a*,4*b*,4*c* is vertical. However, the cave progression direction depends on several parameters, which are amongst others the prevailing rock mass properties, their spatial distribution, the prevailing stress situation, the presence of large faults or shear zones, the presence of previously mined stopes and the implemented draw strategy.

FIG. 5*a*-5*d* schematically illustrate a vertical cross-section of one example of the application of pre-conditioning measures to cave a competent rock mass formation.

Figures 5A, 5B, 5C, 5D:
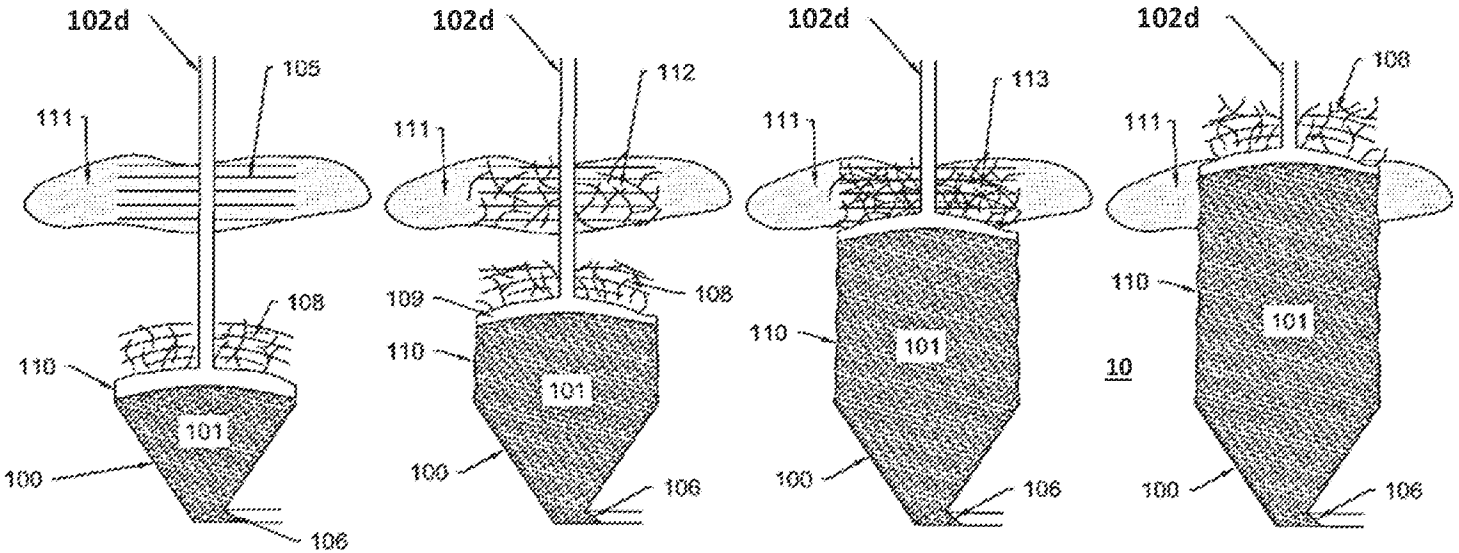
FIGS. 5*a*-5*d* schematically illustrate a vertical cross-section of one example of application of pre-conditioning measures according to the invention.

FIG. 5*a* shows a developed drawbell 100 filled with broken rock mass 101. Caving is initiated and progresses upwards in vertical direction. A zone of fractured rock mass 108 is located above the stope 110. At some distance above the drawbell a competent rock mass formation 111 is prevailing. The position of this competent rock mass formation 111 is such that it will be part of the stope 110 as caving progresses further. This competent rock mass formation 111 does not cave readily due to its strength and caving may stall. To reduce the risk of a cave stall, pre-conditioning measures may be applied selectively in the rock mass above the stope roof and on-demand. FIG. 5*a* illustrates the application of such pre-conditioning measures. Drillholes 105 are drilled from machinery 120 (not shown in figure) operating inside the raise 102*d* into the competent rock mass formation 111 in the region, which should be caved afterwards. These drill holes 105 are subsequently used for application of pre-conditioning measures, such as for example hydraulic fracturing and/or confined blasting. These pre-conditioning measures may be conducted from machinery situated on a platform inside the raise 102*d*.

FIG. 5*b* illustrates that caving progressed further and the stope 110 grew in a vertical direction. Moreover, the pre-conditioning measures were applied and created a pre-conditioned zone 112. It should be noted that pre-conditioning measures and caving of the caving stope 110 below the raise 102*d* can be performed in parallel. By the term "in parallel" is meant that the pre-conditioning measures may be carried out from the raise, whilst caving progresses in the stope underneath. Then pre-conditioning and caving may be performed at two different locations in the stope at the same time. Alternatively, the method steps may be alternated and performed at two different locations in a short period of time. This pre-conditioned zone 112 is characterized by artificial fractures inside the rock mass and/or by a decreased strength of natural discontinuities inside the rock mass. Accordingly, the strength of the rock mass in the pre-conditioned zone 112 is reduced compared to its strength prior pre-conditioning. In FIG. 5*b* the competent rock mass formation 111 was pre-conditioned to facilitate its further caving.

FIG. 5*c* shows that caving has progressed into the previously competent rock mass formation 111. The zone of pre-conditioning 112 and the zone of fractured rock mass 108 overlap and are referred to as a zone of pre-conditioned and fractured rock mass 113.

Due to the pre-conditioning of specifically selected volumes of rock mass the rate of cave progression can be maintained and/or increased in the competent zone, and caving is able to progress through the competent rock mass formation 111 without stalling.

FIG. 5*d* outlines that caving progressed completely through the competent rock mass formation 111. A zone of fractured rock mass 108 is situated above the stope 110 and caving continues to progress further.

The drawbell 100 and stope 110 illustrated in FIG. 5*b*-5*d* are also provided with additional drawpoints arranged on different levels, however these are not shown in the figures.

Observations during development and operation inside raises in the present cave mining method according to the invention may be used for identification of competent rock mass formation requiring pre-conditioning. Moreover, raises enable to access critical rock mass formations to apply pre-conditioning measures selectively and on-demand. Due to the availability of raises pre-conditioning measures may be applied at the same time to drawbell development from said raise and/or to caving of corresponding stope.

However, in another embodiment of the invention, pre-conditioning measures applied from machinery operating inside raises may be used to improve caving rate and thus the possible production rate from a stope.

Figures 6A, 6B, 6C, 6D, 6E:
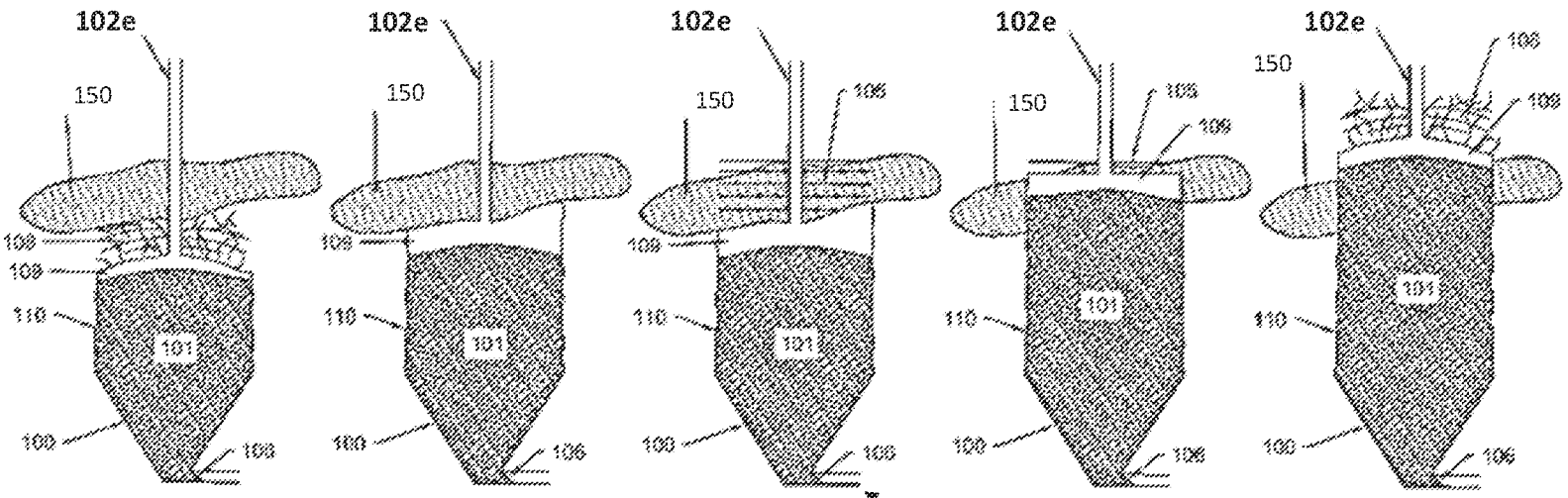
FIGS. 6*a*-6*e* schematically illustrate a vertical cross-section of one example of application of pre-breaking measures according to the invention.

FIG. 6*a*-6*e* illustrate a vertical cross-section of one example of application of pre-breaking measures to advance a caving stope through a highly competent rock mass formation located in a specific area in the rock mass. FIG. 6*a* shows that caving of a stope 110 progresses below a highly competent rock mass formation 150. A zone of fractured rock mass 108 is located above the roof of the stope 110.

In FIG. 6*b* the roof of stope 110 reached the highly competent rock mass formation 150. The zone of fractured rock mass 108 above the roof of stope 110 has caved and fallen into the stope below the rock mass formation 150. Due to the strength of the highly competent rock mass formation 150, caving has stalled and the size of the void 109 has increased significantly.

FIG. 6*c* outlines the application of pre-breaking methods to advance the stope 110 through the highly competent rock mass formation 150. Pre-breaking methods may be performed by switching from caving to drilling and blasting for a limited time period by operating the machinery arranged inside the raise. Therefore, near horizontal drill holes 105 are drilled into the highly competent rock mass formation in a part of the stope from inside the raise by the machinery 120 (not shown in figure) operating inside the raise 102*e*. These drill holes are subsequently blasted slice by slice. FIG. 6*d* shows a situation, where some of the drill holes 105 have been blasted and the stope 110 has partially advanced through the highly competent rock mass formation 150. The size of the void 109 has decreased again. Finally, FIG. 6*e* shows that all drill holes 105 have been blasted and the stope 110 has been advanced through the highly competent rock mass formation 150 completely. Moreover, caving was re-initiated. A zone of fractured rock mass 108 is located above the roof of the stope 110 and caving progresses further. The drawbell 100 and stope 110 illustrated in FIG. 6*a*-6*e* are also provided with additional drawpoints arranged on different levels, however these are not shown in the figures.

However, in another embodiment of the invention other pre-breaking measures than drilling and blasting may be applied.

FIG. 7*a*-7*d* illustrate a vertical cross-section of one example of application of pre-conditioning measures to control the direction of cave progression near a weak rock mass formation.

Figures 7A, 7B, 7C, 7D:
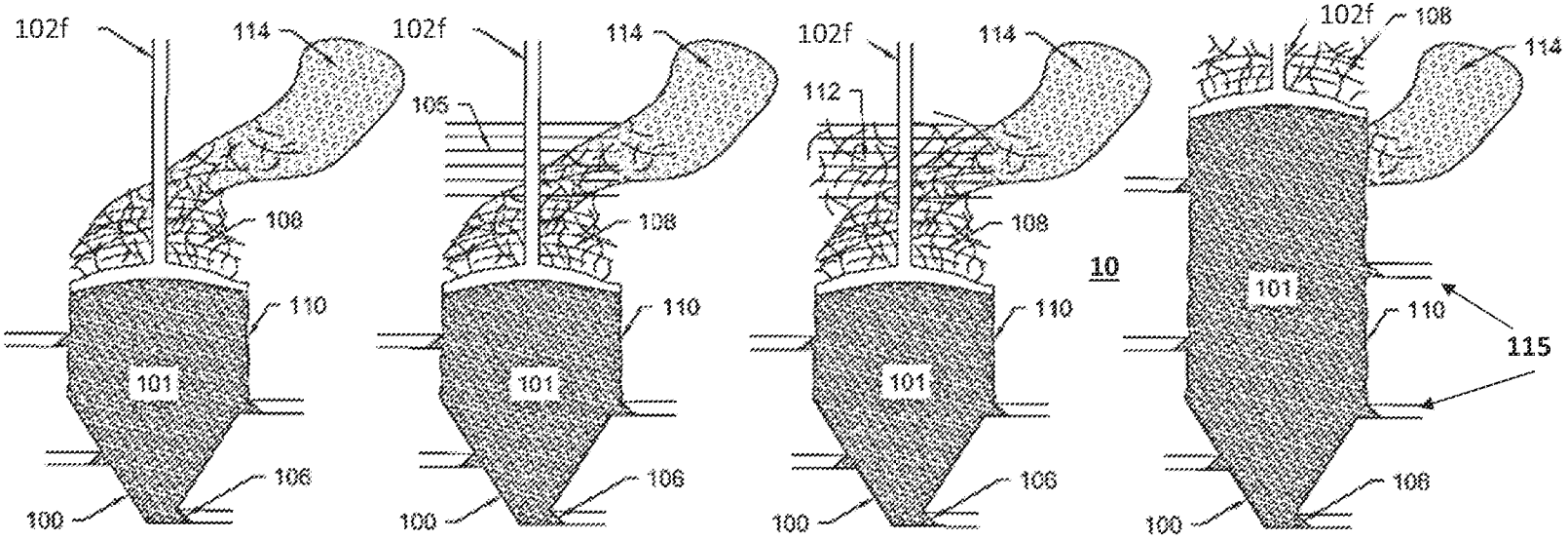
FIG. 7*a*-7*d* schematically illustrate a vertical cross-section of one example of application of pre-conditioning measures according to the invention.

FIG. 7*a* illustrates a stope 110, which is progresses upwards in vertical direction by means of caving. A zone of fractured rock mass 108 is prevailing above the roof of the stope 110. Moreover, a weak rock mass formation 114 is located above the roof of the stope 110. This weak rock mass formation 114 is characterized by a lower strength than its surrounding rock mass formations. Accordingly, caving progresses more easily in and along this weak rock mass formation 114. Thus, caving direction deviates from its planned direction as shown in the figure. The zone of fractured rock mass 108 already extends into the weak rock formation 114.

FIG. 7*b* shows the application of pre-conditioning measures to avoid significant deviation of the direction of cave progression. Therefore, near horizontal drill holes 105 are drilled from machinery operating inside the raise 102*f*. These drill holes 105 are subsequently used for application of pre-conditioning measures, for example hydraulic fracturing and/or confined blasting. These pre-conditioning measures may be conducted from machinery 120 (not shown in this figure) situated on a platform 103 arranged inside the raise 102*f*.

FIG. 7*c* shows that pre-conditioning measures were applied and formed a zone of pre-conditioned rock mass 112. This zone of pre-conditioned rock mass 112 has a reduced strength as either artificial fractures were created, or natural discontinuities were weakened. The reduced rock mass strength in the pre-conditioned zone 112 facilitates caving in the planned direction.

FIG. 7*d* outlines that caving has progressed through the weak rock mass formation 114 without significant deviations into said weak rock mass formation. A suitable draw strategy is applied for drawing broken rock mass from the drawpoints. The draw strategy is critical for controlling direction of cave progression. The presence and arrangement of multiple drawpoints 106 located on several levels also facilitates the implementation of specific draw strategies.

Figure 8C:
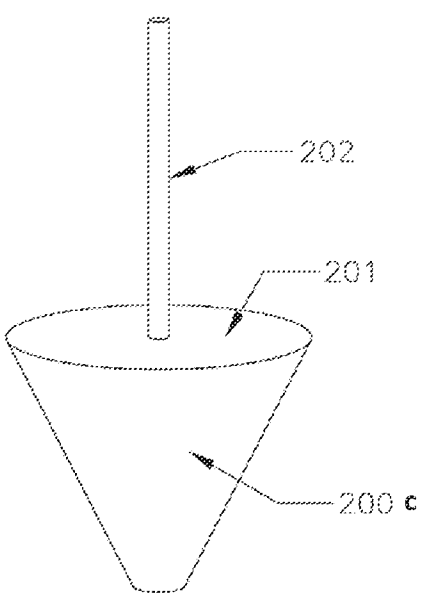
FIG. 8*a*-8*c* schematically illustrate isometric views of examples of alternatives of drawbell configurations according to the invention.
Figure 8B:
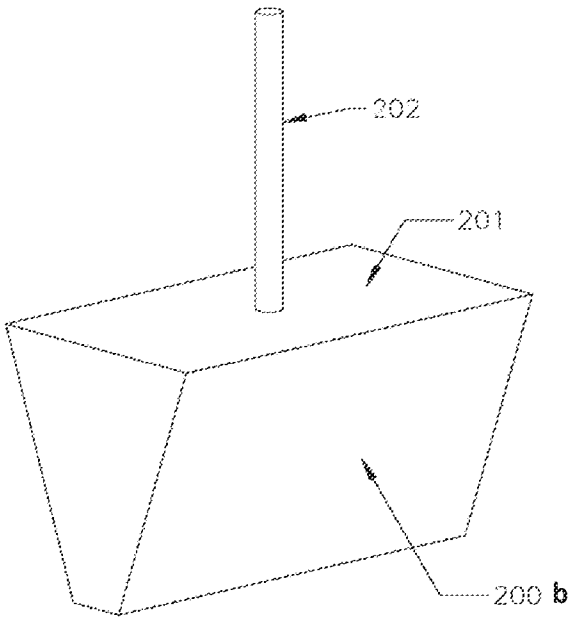
Figure 8A:
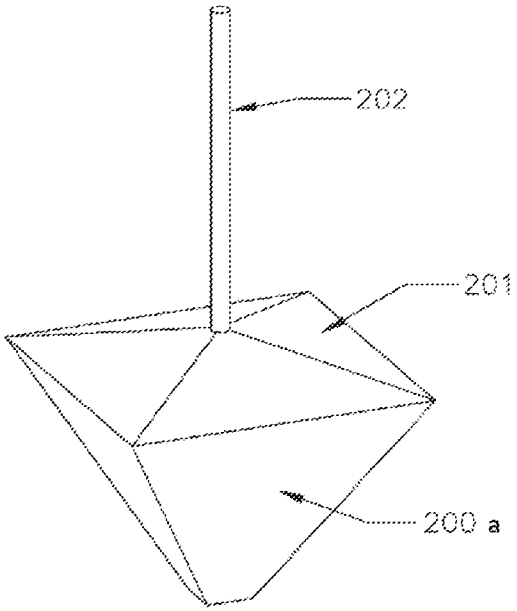

FIG. 8*a*-8*c* illustrate isometric views of different drawbell shapes. The integrated raise caving mining method according to the invention relies on the development of drawbells from raises. Thereby, drawbell shapes may be chosen flexibly in order to meet requirements and prevailing mining environment.

FIG. 8*a* shows a drawbell 200*a* configured as an inverted pyramid such that the sidewalls of the drawbell have different inclinations. The drawbell 200*a* is developed from a vertical raise 202 and has a drawbell roof 201 which is inclined. The drawbell comprises a drawbell bottom and a drawbell roof which are joined by inclined sidewalls. The drawbell is configured with a drawbell roof area being larger than a bottom area of the drawbell, providing that the drawbell widens in a direction upwards. Thus the area of the horizontal cross-section of the drawbell increases in upwards direction. The inverted pyramid shape of the drawbell 200*a* may be adopted flexibly to local requirements, such as rock mass properties, stress situation, or ore flow considerations. For example, the outlined pyramid shaped drawbell 200*a* in FIG. 8*a* has a footprint of 68 m×68 m, a height of 50 m, and a wall inclination of 60°. In one embodiment of the invention, the upper end of the drawbell, adjacent the undercut may be expanded only in upwards direction. In such a way the section of the draw bell just below the undercut obtains nearly vertical walls (not shown in the figures).

FIG. 8*b* shows a drawbell 200*b* designed like a trough with inclined sidewalls, which may have different inclinations, and a drawbell roof area being larger than a bottom area of the drawbell, providing that the drawbell widens in a direction upwards. The drawbell 200*b* is developed from a vertical raise 202 and the drawbell roof 201 is flat. The trough shape of the drawbell 200*b* may be adopted flexibly to local requirements, such as rock mass properties, stress situation, or ore flow considerations. For example, the outlined trough shaped drawbell 200 in FIG. 8*b* has a footprint of 70 m×40 m, a height of 40 m, and a wall inclination of 70°.

FIG. 8*c* shows a drawbell 200*c* configured as an inverted cone, where the narrow cone end is directed downwards. The inverted cone has inclined sidewalls, which may have different inclinations. The drawbell 200*c* is developed from a vertical raise 202 and its drawbell roof 201 is flat. The cone shape of the drawbell 200*c* may be adopted flexibly to local requirements, such as rock mass properties, stress situation, or ore flow considerations. For example, the outlined cone shaped drawbell 200 in FIG. 8*c* has a footprint diameter of 60 m, a height of 50 m, and a wall inclination of 65°.

However, in other embodiments of the invention, the drawbells may be of other shape.

Figure 9C:
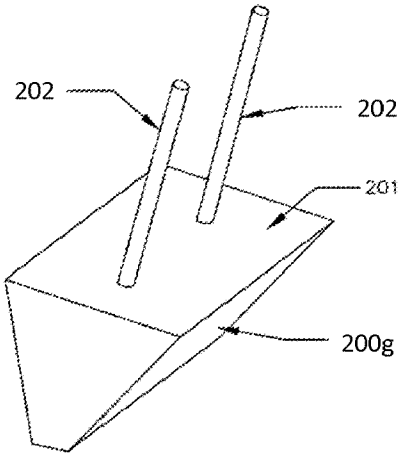
FIG. 9*a*-9*c* schematically illustrate isometric views of examples of alternative drawbell development configurations according to the invention.
Figure 9B:
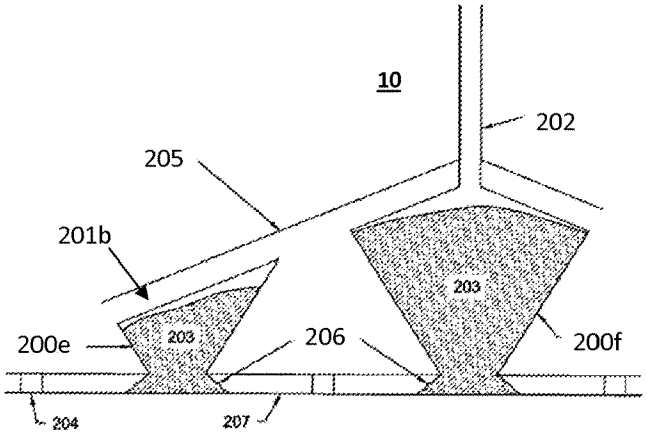
Figure 9A:
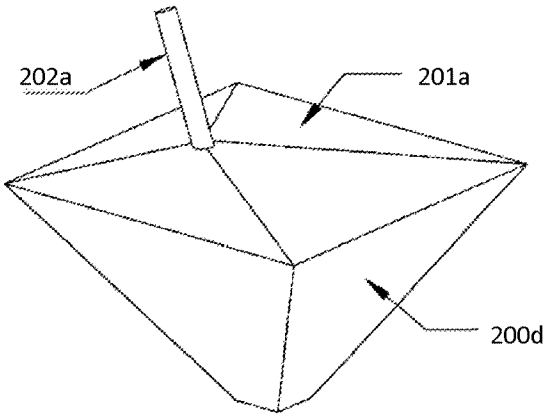

FIG. 9*a*,9*c* illustrate isometric views of drawbell development from inclined raises and more than one raises, respectively. FIG. 9*b* illustrates a vertical cross-section of drawbell development from a raise.

FIG. 9*a* shows a drawbell 200*d* formed as an inverted pyramid. The drawbell 200*d* is developed from an inclined raise 202*a* and the drawbell roof 201 is inclined. The inclination of roof areas may be different for individual parts of the roof. For example, the raise inclination is 70° from the horizontal. The inclined raise 202*a* is positioned offset from the center of the drawbell roof 201. Alternatively, the inclined raise may be positioned in or near the center of the drawbell roof. In another embodiment of the invention, a vertical raise may also be positioned offset from the center of the drawbell roof. Alternatively, the vertical raise is positioned in or near the center of the drawbell roof.

FIG. 9*b* shows two drawbells 200*e*,200*f*. Drawpoints 206 are developed into drawbells 200*e*,200*f*. Drifts 204,207 are oriented in different directions and provide access to the drawpoints. The raise 202 is positioned inside the perimeter of the roof of drawbell 200*f* and is used for development of drawbell 200*f* by means of drilling and blasting performed from machinery operating inside the raise 202. Moreover, raise 202 is also used for development of drawbell 200*e*. Therefore, drill holes 205 are drilled from raise 202 above the drawbell roof 201 band subsequently blasted. Thus, drawbell 200*e* is developed by the raise located in rock mass outside the perimeter of the drawbell roof 201*b*.

Figure 10:
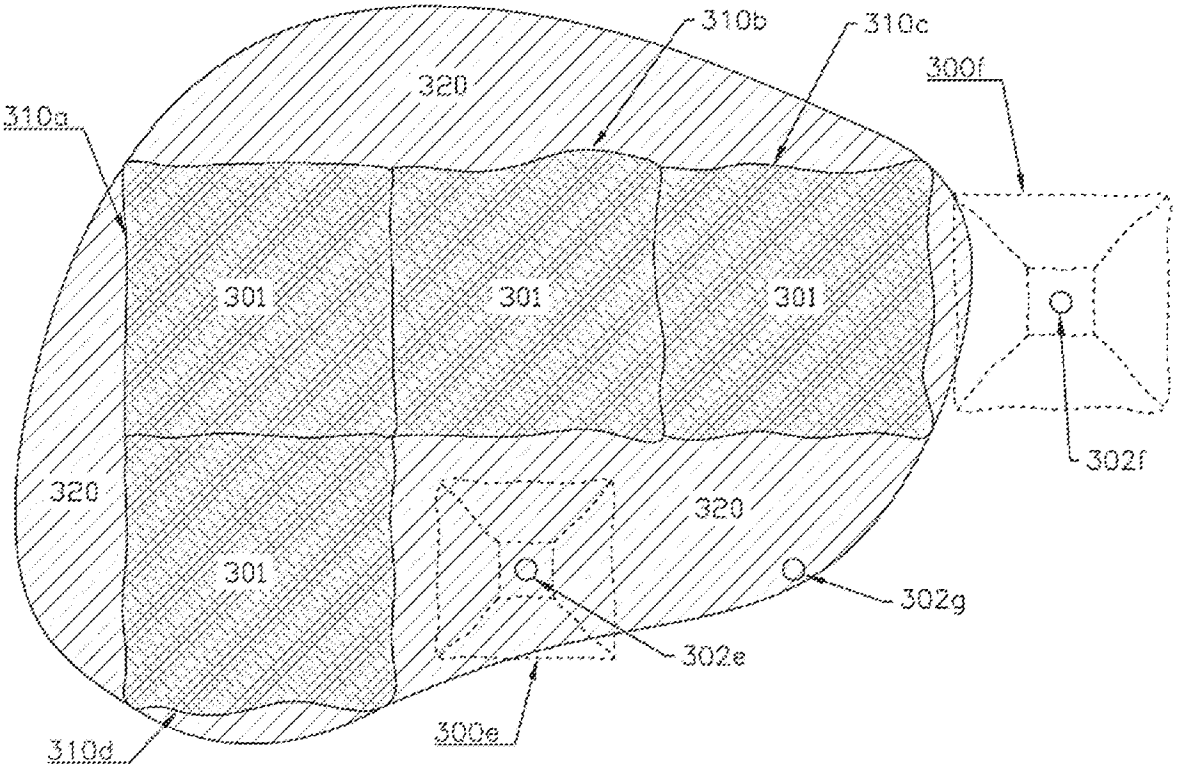
FIG. 10 schematically illustrates a horizontal cross-section of one example of advanced progress of mining a deposit with the integrated raise caving mining method according to the invention.

FIG. 9*c* shows a drawbell 200*g* designed like a trough with inclined sidewalls. The drawbell 200*g* is developed, excavated, from two vertical raises 202 and the drawbell roof 201 is flat. FIG. 10 schematically illustrates a horizontal cross-section of the cave mining method according to the invention in an advanced progress of mining.

As caving progresses, the mined-out caving stopes may provide a stress shadow and, in specific parts of the rock mass, a favourable stress environment. Infrastructure for further drawbell and stope development, such as for example raises, drifts, or drawpoints may be positioned in these stress shadows, thereby protected from high stresses.

Stopes 310*a*,310*b*,310*c*,310*d* have been undercut and caving progresses. The stopes are filled with broken rock mass 301. In parallel, drawbells 300*e*,300*f* are developed from raises 302*e*,302*f*. The drawbells are shown as hatched lines, as drawbells are not visible in the shown cross-section, but rather located at predefined elevation below the shown cross-section. Thus, the hatched lines indicate the development and position of drawbells 300*e*,300*f*. Another raise 302*g* has also been developed for subsequent development of the corresponding drawbell. FIG. 10 further shows a stress shadow 320, thus a favorable stress environment formed near mined stopes 310*a*,310*b*,310*c*,310*d*. The actual distribution of the stress-shadow 320 and the favorable stress environment depend also on the prevailing rock mass conditions, primary stress magnitudes and directions as well as the mine layout and mining sequence. This stress shadow 320 protects raises 302*e*,302*g* from potentially high stresses, which may be present at the position of raises 302*e*,302*g*, in case no stress shadow would be provided. This circumstance concerns raise 302*f*, which is located at a position, where no stress shadow is present. However, raise 302*f* may be protected from high stresses by specifically designed de-stress excavations (not shown in FIG. 10), which have the function of providing a stress shadow, thus favorable stress environment for specific infrastructure. In summary, ongoing mining may provide stress shadows at specific locations. The delayed infrastructure development in the present cave mining method according to the invention allows use of these stress shadows for infrastructure protection strategically. Thereby, infrastructure stability is improved, which in turn affects the safety, economics, and extraction of the deposit positively.

FIG. 11*a*-11*e* schematically illustrate isometric views of one example of an implementation of the integrated raise caving mining method according to the invention. The figures show one example of the integration of the individual steps of the method as described herein. The development of drawbells from raises and development of infrastructure, such as drifts and drawpoints are shown. Moreover, undercutting, cave initiation, and cave progression, thereby mining of caving stopes are outlined. It should be noted that the mining layout of the example of the integrated raise caving mining method as illustrated in the figures is very flexible.

Finally, the FIGS. 11*a*-11*e* illustrate an example of a mining sequence of the integrated raise caving mining method.

Figure 11A:
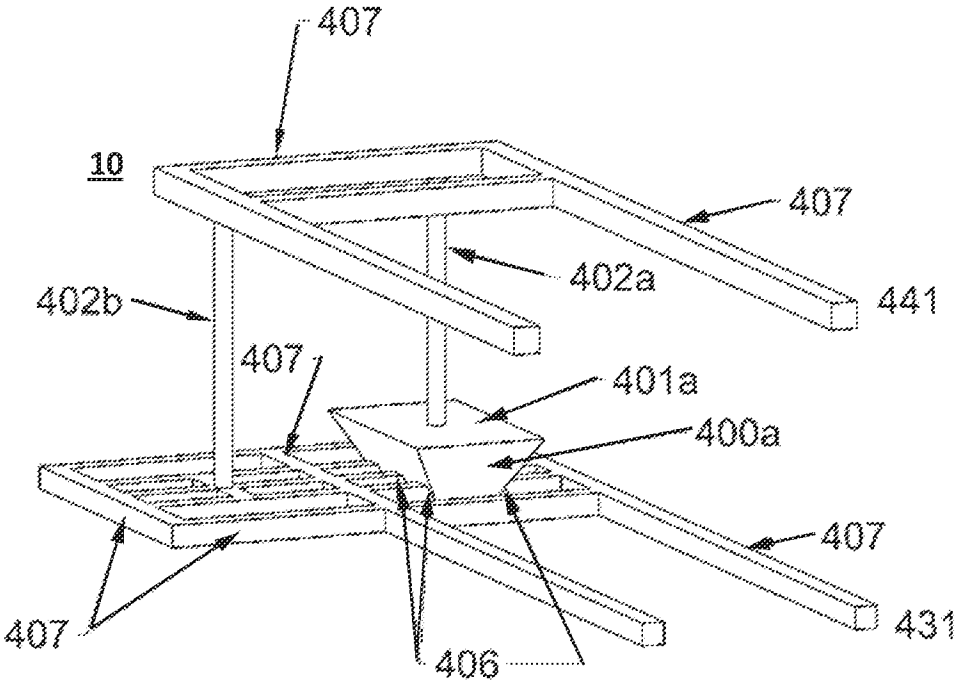

FIG. 11*a* provides an isometric view of the initial stages of the integrated raise caving mining method and shows the development of the infrastructure required for the first drawbells as well as the development of the first drawbell. Infrastructure comprises drifts 407, drawpoints 406 and raises 402*a*,402*b*. Drifts 407 have been developed at a production level 431 and at a raise level 441. It should be noted that the terms "production level" and "draw level" are synonyms. Afterwards raises 402*a*,402*b* have been developed between the production level 431 and the raise level 441. Thus, the raises 402*a*,402*b* are developed to extend over only a part of the stope height above the drawbell. Raises may be developed by means of raise boring method or by means of other methods. The distance between the production level 431 and the raise level 441 is influenced amongst others by the final drawbell height, the prevailing rock mass and stress conditions and the applied mining sequence. Raise 402*a* is used for the development of the first drawbell 400*a* by means of drilling and charging. At least a part of an undercut is created through gradually expanding the drawball in upwards direction by excavation, and increasing the roof area of the drawbell. Therefore, machinery 120 suitable for drilling and blasting (not shown in figure) operating inside the raise is used. The drawbell 400*a* has not been developed to the final size and shape yet. The latter circumstance implies that the roof area of the flat drawbell roof 401*a* is still smaller than the final drawbell roof size. Accordingly, caving has not been initiated yet. After every blast, blasted rock mass falls from the drawbell roof 401*a* into the drawbell 400*a*. The blasted rock mass is loaded at drawpoints 406 out of the drawbell 400*a*. Thereby, a void is formed below the drawbell roof 401*a*. This void is required for subsequent blasts, to accommodate the swell of the blasted rock mass. Due to the inverted-pyramid shape of the drawbell 400*a*, blasted material inside the drawbell flows to the bottom of the drawbell, where it is loaded at drawpoints 406. The number, size, and spacing of drawpoints 406 depends on prevailing rock mass and stress conditions as well as on ore flow aspects, for example the fragmentation of the broken rock mass inside the drawbell, or the applied draw strategy. However, in another embodiment of the invention, the drawbell may also be of other shape, for example a trough shape, or inverse cone shape. After loading material at drawpoints 406, the material is transported in drifts 407 to the ore handling system, which may be located inside or outside the active mining area (the ore handling system is not shown in the Figure). FIG. 11*a* shows besides development of the first drawbell 400*a* the infrastructure required for the development of the second drawbell.

Figure 11B:
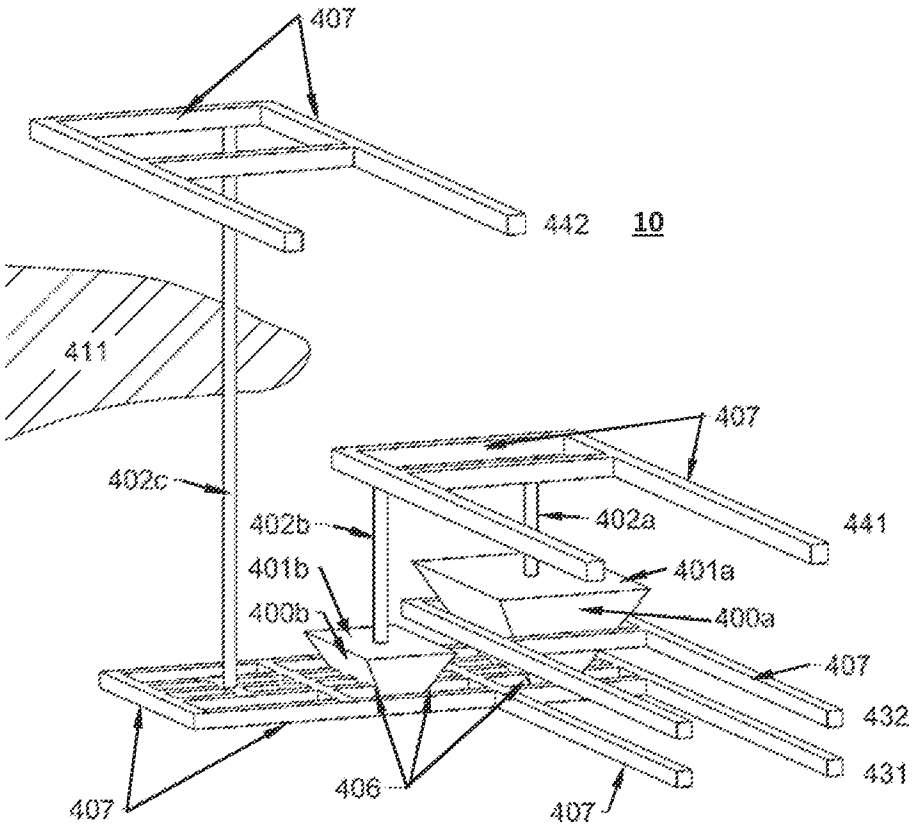

FIG. 11*b* provides an isometric view of one example of a more advanced stage of drawbell and infrastructure development of the method according to the invention, than FIG. 11*a*. The drawbell 400*a* has been developed to its predefined height. Thus, the roof 401*a* of the drawbell reached its final size. Thus, raise 402*a* is not required for further drilling and charging activities of the drawbell 400*a*. However, the raise 402*a* may still be used for monitoring purposes, for example the drawbell roof 401*a*, or the broken rock mass inside the drawbell 400*a*. Moreover, the raise 402*a* may still be used for additional pre-conditioning methods and/or pre-breaking methods in specific locations in the rock mass above the drawbell roof 401*a* on demand. The size of the drawbell roof 401*a* is still too small to initiate caving. To increase the size of the undercut and to initiate caving subsequently, drawbell 400*b* is under development. Therefore, drilling and blasting in raise 402*b* is used. Blasted rock mass from drawbell development is drawn from drawbell 400*b* at drawpoints 406 situated at the production level 431. The drawbell 400*b* has not reached its final size and shape yet.

Moreover, FIG. 11*b* shows that a second production level 432, which is located at a predetermined distance above the first draw level 431, has been developed. Drifts 407 were developed. Some of these drifts are located near the drawbell 400*a*. In a later stage, further drawpoints will be developed from said drifts 407 into the drawbell 400*a*.

FIG. 11*b* outlines the further extension of the method according to the invention. Drifts 407 have been developed at a second raise level 442 and drifts 407 have been extended or newly developed at draw level 431. Additionally, a third raise 402*c* has been developed between drifts 407 at the draw level 431 and drifts 407 at the raise level 442. The raise level 442 is located at a higher elevation than raise level 441. The reason, therefore, is that a zone of competent rock mass 411 is present near raise 402*c* and between raise levels 441 and 442. This zone of competent rock mass requires pre-conditioning. The pre-conditioning measures may be conducted from machinery 120 (not shown in figure) operating inside the raise 402*c* before drawbell development from raise 402*c* starts. However, in another embodiment of the invention, said pre-conditioning measures and drawbell development may be conducted from the same raise in parallel. This means that these method steps may be performed at the same time. Alternatively, pre-conditioning may be conducted during cave progression below the competent rock mass zone. FIG. 11*b* shows further that pre-conditioning measures can be applied in the competent zone selectively, because the raise 402*c* intersects the competent zone.

The zone of competent rock mass 411 does not extend in the area above raise level 441. There was no requirement for pre-conditioning in the area above raise level 441. For this reason, raise level 441 is located closer to the draw level 431, which is used for drawbell development, so that costs for infrastructure development can be reduced. Consequently, the position of raise levels and infrastructure in the integrated raise caving mining method can be adapted to local conditions.

Figure 11C:
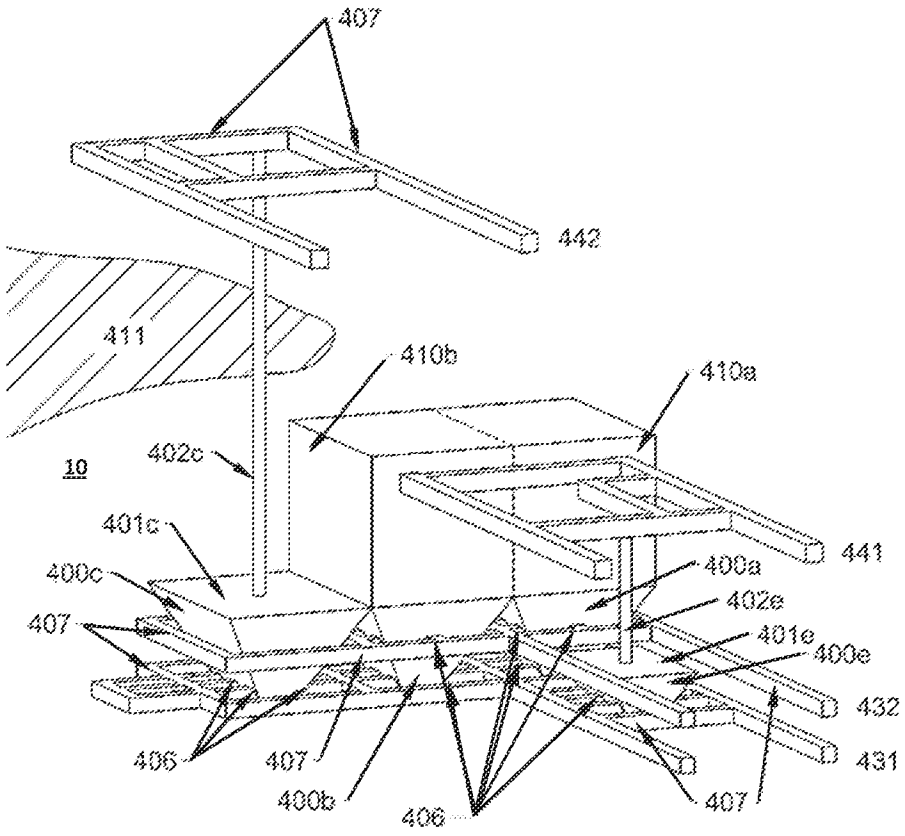

FIG. 11*c* provides an isometric view of one example of the method according to the invention of a stage, where caving has been initiated through undercutting. Further infrastructure was developed for additional drawbells and caving stopes. Drawbell 400*b* is completely developed. Accordingly, drawbell roofs 401*a*,401*b* of drawbells 400*a*, 400*b* have been joined and connected. The connected roof area of drawbells 400*a*,400*b* exceeded the critical unsupported area required for cave initiation. Thus, caving has been initiated and progresses upwards. As caving progresses upwards the volume of the caving stopes 410*a*,410*b* increases. As caving stopes 410*a*,410*b* are adjacent to each other they form a larger coherent caving stope. Caved rock mass in stopes 410*a*,410*b* is drawn through drawbells 400*a*, 400*b* at drawpoints 406. Consequently, a void forms on top of the caved rock mass in stopes 410*a*,410*b*, which allows further detachment of rock mass from the cave back, as loading of the broken rock mass is performed through drawpoints 406, thereby caving progresses. Caving in stopes 410*a*,410*b* progressed above raise level 441. Accordingly, there are no further raises above the caving stopes 410*a*, 410*b* available for monitoring, pre-conditioning or pre-breaking measures.

Drawpoints 406 are located at the production levels 431,432. Drawpoints situated at production level 432 located above level 431 were developed delayed. This means that drawpoints 406 at the production level 432 were developed into the drawbells 400*a*,400*b* after drawbell development was completed and after caving was initiated. This delayed drawpoint development enables to protect drawpoints from high stresses during drawbell development and associated undercutting as well as to position the drawpoints 406 according local rock mass conditions and ore flow considerations. Moreover, drawpoints 406 were developed into drawbells 400*a*,400*b* in different directions. Overall, the development of drawpoints 406 on more than one draw levels provides the possibility to improve the drawpoints arrangement from an ore flow point of view.

FIG. 11*c* outlines that infrastructure on raise levels 441, 442 and production levels 431,432 have been extended to prepare further parts of the ore body for extraction. Drawbell 400*c* is fully developed. The drawbell roof 401*c* is connected to the caving stope 410*b*. Consequently, the undercut area has been increased and a zone of fractured rock mass is just about to develop in the rock mass 10 above the drawbell roof 401*c*. However, caving has not progressed yet above drawbell roof 401*c*. In addition to drawbell 400*c*, drawbell 400*e* is under development. Therefore, a raise 402*e* has been developed between the production level 431 and the raise level 441. Said raise 402*e* may benefit from a stress shadow. Thus, a favorable stress environment is provided by caving stopes 410*a*, 410*b*. The extent of this stress shadow and the benefit of raise 402*e* of the stress shadow depend amongst others on the prevailing stress and rock mass conditions and on the position of raise 402*e* in respect to stopes 410*a*, 410*b*.

FIG. 11*c* highlights that the infrastructure, required for increasing the production area, may be developed shortly before production commences in respective areas. Moreover, the mining layout of the integrated raise caving mining method, according to the invention, allows parallel infrastructure development and production ramp-up.

Figure 11D:
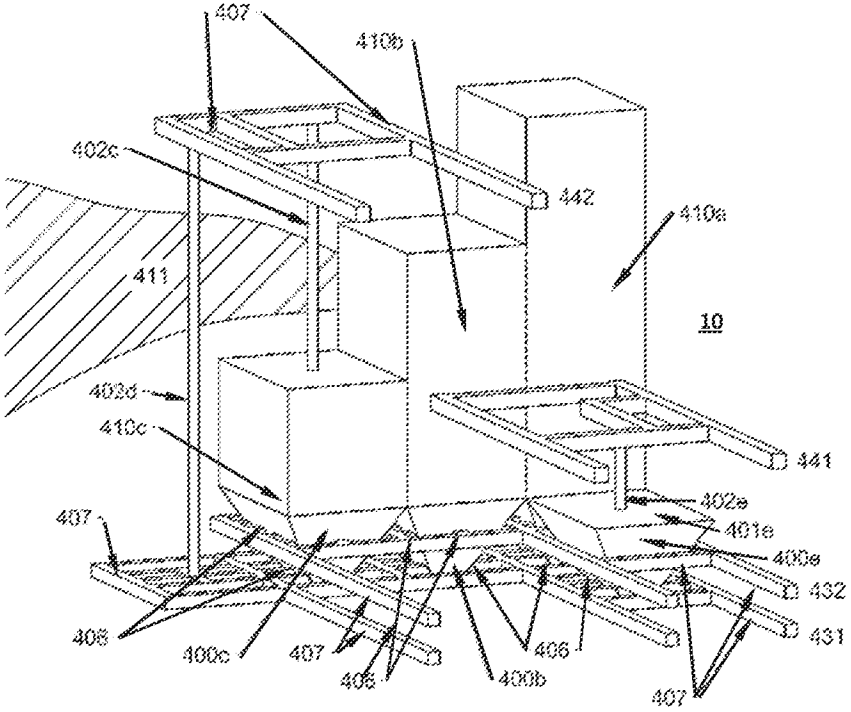
Figure 11A:
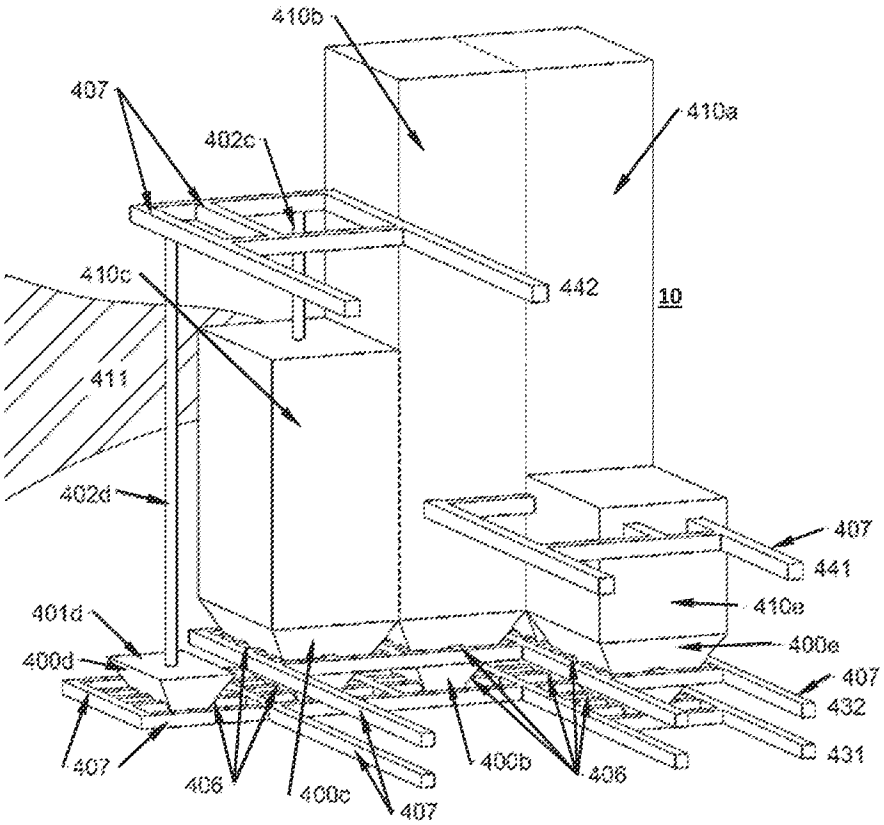

FIG. 11*d* provides an isometric view of one example of a stage of the method according to the invention, where several drawbells are fully developed and where caving progressed in several stopes. Drawbells 400*a*,400*b*,400*c*, 400*e* are fully developed and caving in stopes 410*a*,410*b*, 410*c* progressed. So far, caving has not progressed above drawbell 400*e*. However, the drawbell roof 401*e* of drawbell 400*e* has already been connected to the stope 410*a*. Thereby the size of the undercut area has increased further. Moreover, further infrastructure has been developed. Raise 402*d* is developed between raise level 442 and the production level 431. Raise 402*d* intersects the strong competent zone and enables the planned application of pre-conditioning measures in the competent zone 411. Additionally, new drifts 407 have been developed on production levels 431,432.

FIG. 11*e* provides an isometric view of one example of continuing infrastructure development and cave progression in the method according to the invention. The volume of caving stopes 410*a*,410*b*,410*c*,410*e* has increased and development of drawbell 400*d* started.

The example of the invention as shown in FIG. 11*e*, further comprises infrastructure and drawbells for two additional stopes arranged to the left of stope 410*e*, but to avoid further complexity of FIG. 11*e* those features are not shown.

Overall, FIGS. 11*a*,11*b*,11*c*,11*d*,11*e* illustrate the principle steps of the integrated raise caving mining method according to the invention. The actual mine layout and mining sequence depend on several parameters, such as the ore body geometry, the ore body size, the grade distribution, the prevailing rock mass properties, the prevailing stress situation, and the production. Moreover, the mine layout and mining sequence may be adapted flexibly and on short notice to encountered conditions and circumstances.

Figure 12C:
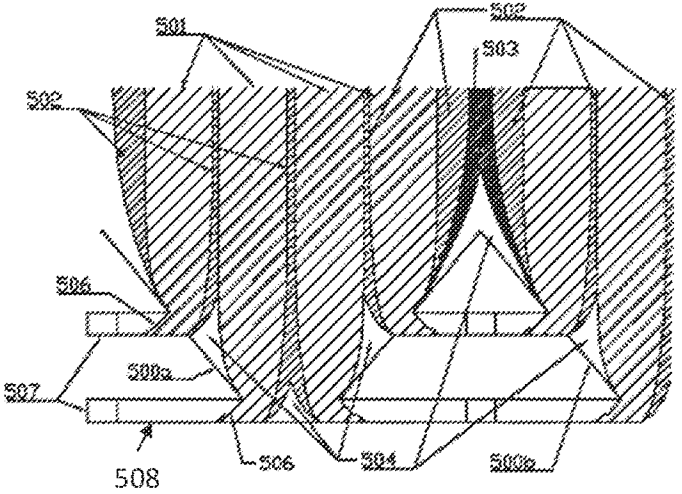
FIG. 12*a*-12*c* schematically illustrate vertical cross-sections of examples of drawpoints and draw zones during production of the method according to the invention.
Figure 12B:
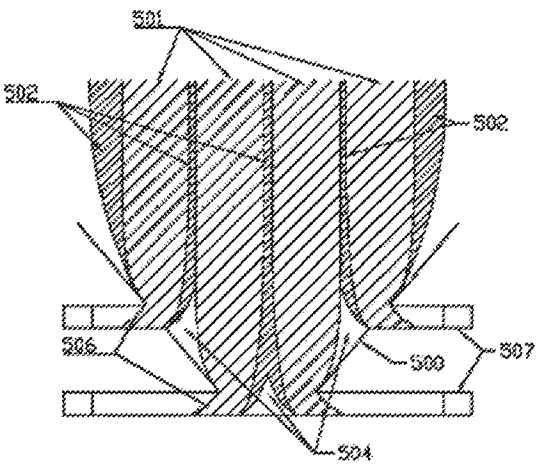
Figure 12A:
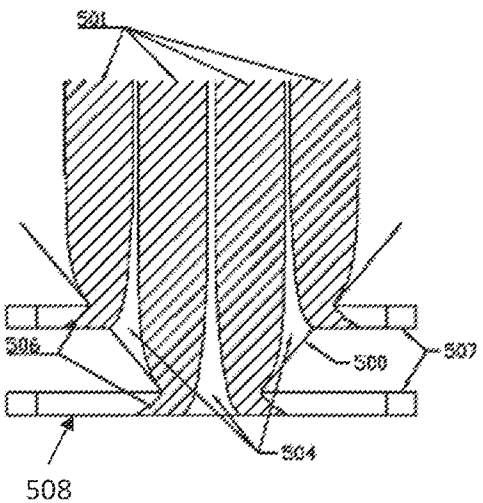

FIG. 12*a*-12*c* schematically illustrate vertical cross-sections of examples of the method according to the invention. FIGS. 12*a-c* show the draw zones of individual drawpoints and the development of an interactive draw zone.

FIG. 12*a* provides a vertical cross-section of one example of a drawbell 500 and shows the effect of drawing drawpoints in isolation. Drawpoints 506 are developed into the drawbell 500. Access tunnels 507 and 508 are used as an access to the drawpoints 506. Drawing broken rock mass from drawpoints 506 maintains the flow of broken rock mass inside the drawbell towards the drawpoints 506. However, every drawpoint 506 maintains the flow of broken rock mass only in a certain area. This area is commonly referred to as isolated draw zone 501. Drawpoints 506 are drawn in isolation, which means that one drawpoint is drawn at a time, and drawing from a neighboring drawpoint commences only after a considerable time period. Thus, the draw is considered to be not uniform, both temporarily and spatially. Drawpoints 506 are arranged such that their isolated draw zones 501 do not touch or intersect each other. Correspondingly, a zone of relatively stationary material 504 remains between neighboring draw zones 501. This zone of relatively stationary material 504 is characterized by broken rock mass, which is either not flowing at all or which is flowing at a very slow rate compared to the material inside the isolated draw zone 501. The size and shape of the isolated draw zone 501 depend on several parameters, which comprise amongst others the fragmentation of the broken rock mass, the size and shape of the drawpoint and the prevailing stress situation inside the broken rock mass.

However, in another embodiment of the invention drawpoints may be arranged such that their isolated draw zones overlap at least in some areas. Thus, there is smaller zone of relatively stationary material between neighboring isolated draw zones.

FIG. 12*b* shows a vertical cross-section of one example of a drawbell 500 with four drawpoints 506 and illustrates the effects of drawing drawpoints interactively. Drawpoints are accessed from access tunnels 507. Isolated draw zones 501 develop above corresponding drawpoints 506 due to draw of rock mass. However, in contrast to FIG. 12*a* drawing from drawpoints 506 is carried out in FIG. 12*b* interactively. This interactive draw is realized by drawing broken rock mass from neighboring drawpoints at the same time or within a short time interval. As drawpoints 506 are drawn interactively, isolated draw zones of individual drawpoints start to interact. Consequently, broken rock mass between neighboring isolated draw zones 501 starts to move as well. Therefore, an interactive draw zone 502 develops near isolated draw zones 501. The size and shape of this interactive draw zone 502 depend on several parameters, for example the applied draw strategy, the arrangement of drawpoints, or the fragmentation of the broken rock mass. A uniform draw both temporarily and spatially from drawpoints is pursued to enlarge the interaction in the interactive draw zone. Overall, the interactive draw zone 502 effect is that the flow of broken rock mass is maintained in a larger volume of broken rock mass compared to the volume of isolated draw zone 501. Moreover, raises 102 (not shown in this figure) used for development of the drawbell may be used for monitoring the fragmentation, the lowering of broken rock mass inside a caving stope, the cave and/or cave back. This monitoring information/data may then be used for draw control and eventually to adapt the draw strategy such that a better interactive draw can be achieved. A zone of relatively stationary material 504 may still be present, especially near the sidewalls of the drawbell.

FIG. 12*c* provides a vertical cross-section of one example of two drawbells 500*a*,500*b* and illustrates the effect of drawing broken rock mass from neighboring drawbells interactively. Drawpoints 506 developed from access tunnels 507 are used for drawing broken rock mass from drawbells. Drawpoints 506 of individual drawbells 500*a*, 500*b* are drawn interactively. Thereby, the isolated draw zones 501 of corresponding drawpoints form an interactive draw zone 502 in every drawbell 500*a*,500*b*. Interactive draw zones 502 of drawbell 500*a* and 500*b* do not intersect or touch each other. Due to the draw of broken rock mass from neighboring drawbells 500*a*,500*b* in the same time period, interactive draw zones 502 start to interact, thereby forming an interactive draw zone across drawbells 503. Moreover, the inclined sidewalls of drawbells further assist latter interaction. Thus, the interactive draw in each drawbell results in larger drawbell interactive zones, which interact across the drawbells. The size and shape of this interactive draw zone across drawbells 503 depends on several parameters, for example the applied draw strategy, the size and shape of neighboring drawbells, or the arrangement of drawpoints. Due to the development of the interactive draw zone across drawbells 503, a uniform mass flow of broken rock mass is implemented across the drawbells. A zone of relatively stationary material 504 may still be present, especially near the sidewalls of the drawbell.

However, in another embodiment of the invention, drawbells may be arranged such that the interactive draw zones from drawbells overlap at least in some areas.

Figure 13A:
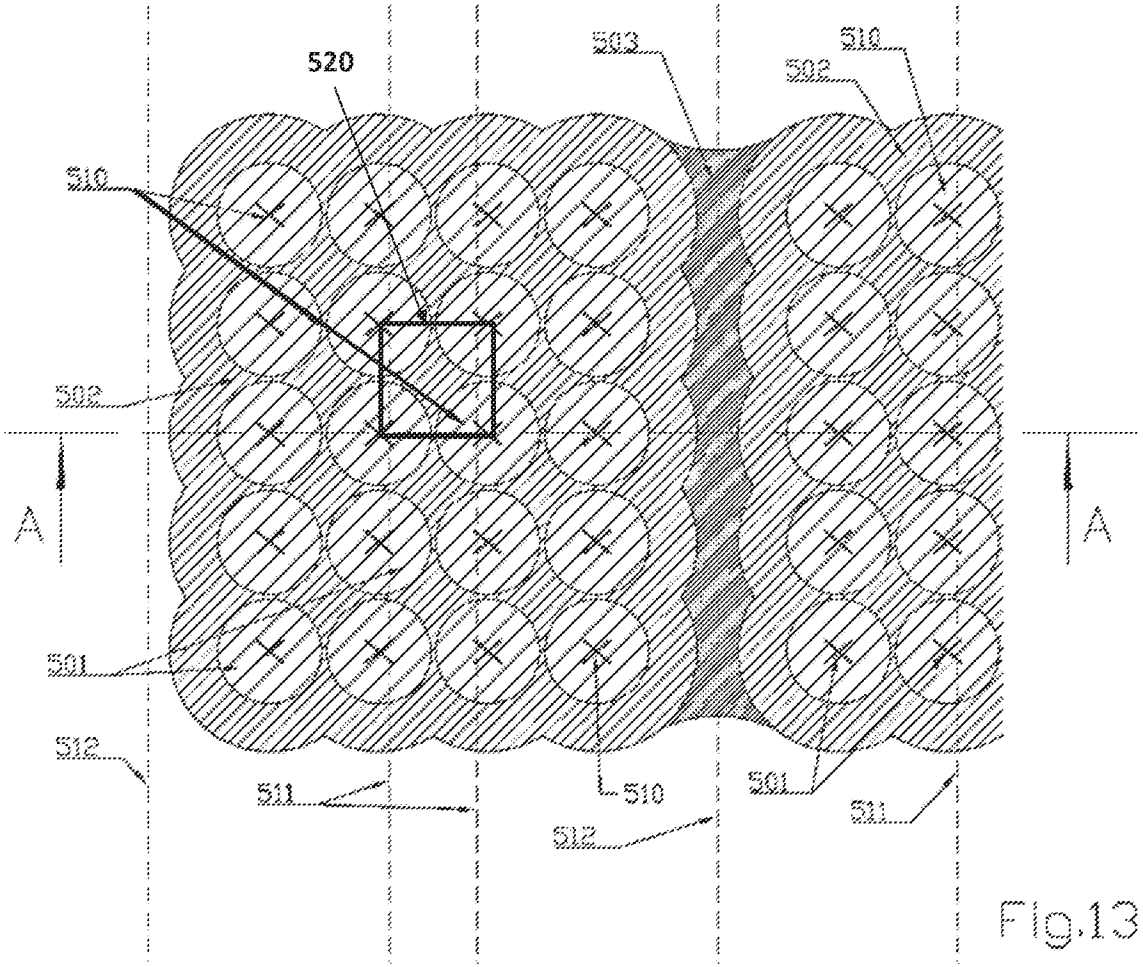
FIG. 13*a*-13*b* schematically illustrates an example of an arrangement of isolated and interactive draw zones during production of the integrated raise caving mining method according to the invention.
Figure 13B:
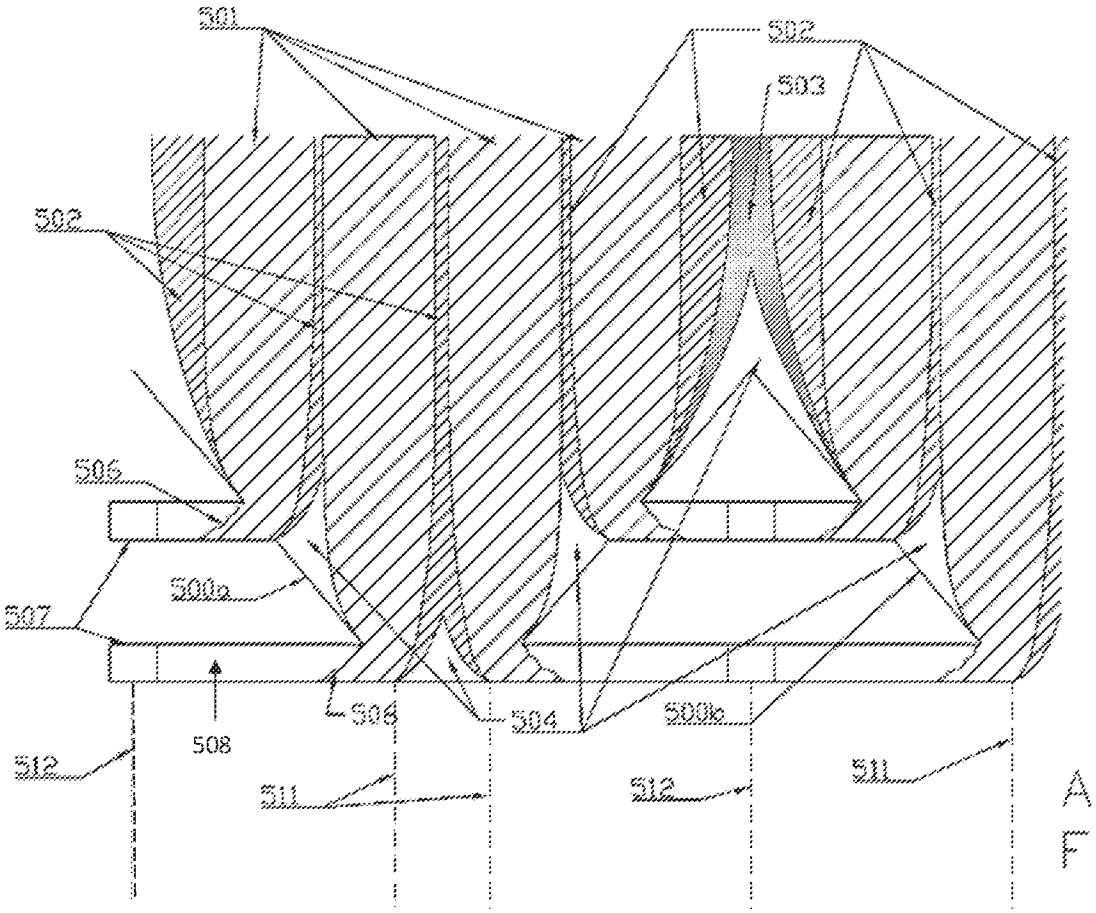

FIG. 13*a* schematically illustrates a horizontal cross-section of an example of the method according to the invention and shows the arrangement of isolated and interactive draw zones. FIG. 13*b* schematically illustrates a vertical section along line A-A of FIG. 13*a*.

FIG. 13*a* provides a horizontal cross-section of a coherent caving stope located above neighboring drawbells 500*a*, 500*b*. The drawbells are indicated by dashed lines, whereas lines 511 indicate the bottom of the drawbells and lines 512 indicate the top of the drawbells. The drawbells 500*a*,500*b* have a trough shape and the drawpoints are developed into the drawbells.

The position of the drawpoint centers are shown by a cross-symbol 510. All drawpoints in FIG. 13*a* are drawn interactively. For this reason, an interactive draw zone 502 is created surrounding the isolated draw zones 501 of each drawpoint. Moreover, an interactive draw zone 503 across drawbells is established, because drawpoints from the neighboring drawbells are drawn in the same time period. The drawpoints in FIG. 13*a* are arranged in a square layout 520.

FIG. 13*b* shows the drawbells 500*a*,500*b* and the arrangement of isolated and interactive draw zones as illustrated in FIG. 13*a*.

However, in another embodiment of the invention, the drawpoints may be arranged in other layouts, for example a staggered or rectangular layout. The actual arrangement of drawpoints depends on local circumstances, for example the fragmentation of rock mass, the size and shape of drawpoints, the size and shape of drawbells, or the applied draw strategy.

Draw strategy is considered important for controlling the cave progression and direction, because it governs the development of the void below the zone of fractured rock mass and the broken rock mass inside the stope. Moreover, information gained from monitoring the cave back and broken rock mass pile from raises may be used to adopt the draw strategy appropriately, flexibly, and on short notice.

Figure 14:
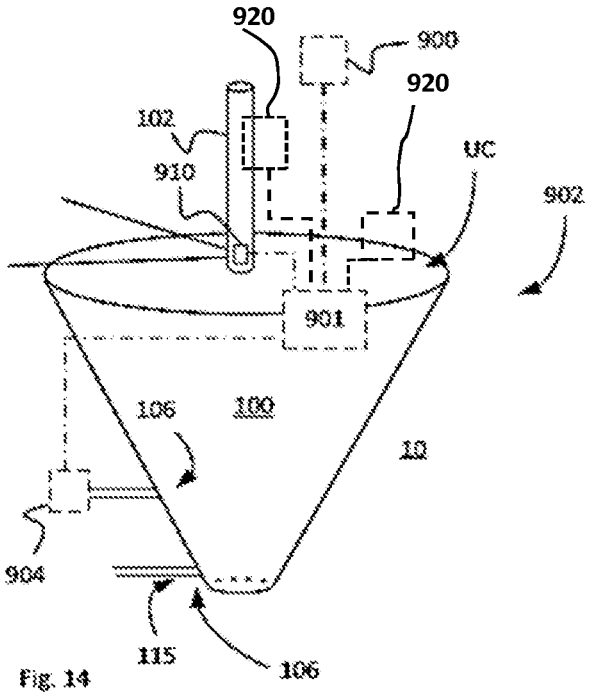
FIG. 14 schematically illustrates an integrated cave mining infrastructure comprising an automatic or semi-automatic apparatus electrically coupled to a control circuitry.

FIG. 14 schematically illustrates an integrated raise caving mining infrastructure 902 comprising an automatic or semi-automatic control system 901 electrically coupled to a control circuitry 900. The integrated raise caving mining infrastructure 902 is configured for mining deposits in a rock mass 10 and comprises at least one raise 102 developed in a direction upwardly from a drift 115 located in the rock mass 10. A drawbell 100 is developed in the rock mass 10, wherein at least a portion of the drawbell is joined to the at least one raise 102. The integrated raise caving mining infrastructure 902 comprises an undercut UC, wherein at least a portion of the undercut UC is formed as a drawbell roof of the drawbell 100, and wherein said portion has been created by gradually expanding the drawbell in upward direction by excavation. The integrated raise caving mining infrastructure 902 further comprises at least two drawpoints 106 joined to the drawbell 100, wherein the drawpoints 106 are joined to drifts arranged on different levels, and comprises a transport device 904 configured to progressively draw fragmented rock from the drawbell 100.

Alternatively, a caving stope (not shown) is located above the drawbell 100. The drawbell of the integrated raise caving mining infrastructure 902 may have other shapes than that shown in the figure.

The integrated raise caving mining infrastructure 902 may further comprise a machinery 910 that may comprise a drilling and/or charging device (not shown) configured for developing the raise 102 in the rock mass 10. The machinery 910 is configured for developing the drawbell 100 in the rock mass 10, wherein at least a portion of the drawbell is excavated from the raise by drilling, and/or charging by means of the machinery 910, thereby initiating caving through undercutting. The machinery 910 is configured for developing the drawbell by gradually expanding the drawbell in upwards direction by excavation and for developing the at least two drawpoints 106 into the drawbell 100, wherein the drawpoints 106 are developed from drifts arranged on different levels. The machinery 910 may comprise the transport device 904 configured for transporting fragmented rock from the drawbell 100 through the drawpoints 106.

The machinery 910 may be configured to be operated by the automatic or semi-automatic control system 901 in remote control mode and/or in automatic control mode and/or in semi-automatic control mode.

The machinery 910 may be configured for drilling and/or charging the rock mass from inside the raise 102. The machinery 910 may comprise a drilling bore and/or charging equipment configured for initiating said caving. The machinery 910 may comprise pre-conditioning equipment. The machinery 910 may comprise that the drilling and/or charging device is arranged on a movable platform, which is movable within the raise 102 for reaching a position for operation of the drilling and/or charging device. The machinery 910 may comprise that the platform is configured with a modular design. The machinery 910 may comprise that the platform is configured to be stored by moving it aside from the top of the raise. The machinery 910 and/or equipment arranged on the platform may be configured with a modular design. The machinery 910 may be configured for installing rock support and/or rock reinforcement from inside the raise 102, such as rock bolts, mesh, shotcrete, cable bolts. The machinery 910 may be configured for hydrofracturing the rock mass from inside the raise 102. The machinery 910 may be configured for performing directional drilling. The machinery 910 may be configured for drilling curved boreholes by directional drilling. The machinery 910 may be configured for blast initiation of the charged boreholes. The machinery 910 may be configured for blast initiation from inside the raise 102. The machinery 910 may be configured for blast initiation by wired detonators and/or remote-controlled detonators and/or non-electric detonators and/or wireless detonators. The machinery 910 may be configured for transporting fragmented rock 101 continuous draw machinery with conveyors and/or trucks and/or loaders. The machinery 910 may be configured to be operated by remote control. The machinery 910 may be configured for semiautomation or full automation. The machinery 910 may be configured to be operated manually.

The integrated raise caving mining infrastructure 902 may further comprise a monitoring system 920 configured for monitoring an integrated raise caving mining infrastructure 902 configured for mining deposits in rock mass.

The monitoring system 920 comprises monitoring means configured for monitoring development of at least one raise 102, 102*a-f*, 202, 302*a-g*, 402*a-e* developed in the rock mass 10. The monitoring system 920 comprises monitoring means configured for monitoring development of a drawbell 100, 100*a-c*, 200*a-g*, 300*a-f*, 400*a-e* in the rock mass 10, wherein at least a portion of the drawbell is joined to the at least one raise 102, 102*a-f*, 202, 302*a-g*, 402*a-e*. The monitoring system 920 comprises monitoring means configured for monitoring development of an undercut (UC) being configured to initiate caving of rock mass located above the undercut, wherein said portion has been created by gradually expanding the drawbell in upward direction by excavation. The monitoring system 920 comprises monitoring means configured for monitoring initiation of caving. The monitoring system 920 comprises monitoring means configured for monitoring development of at least two drawpoints 106, 206, 406 wherein the drawpoints 106 are joined to drifts 115,207,407 arranged on different levels. The monitoring system 920 may be configured for monitoring of a transport device 904 configured to progressively draw fragmented rock (101) from the drawbell. The monitoring system 920 may be configured for monitoring cave progression and/or direction of cave progression. The monitoring system 920 may be configured for monitoring of caved rock mass by using a remote controlled monitoring device arranged inside the raise. The monitoring system 920 may be configured for remotely monitoring of the caving stope and/or the cave back (119) and/or the caved rock masses (101). The monitoring system 920 may be configured for monitoring an advancing fracture and loosening zone located above the cave back. The monitoring system 920 may be configured for monitoring seismicity and/or stress in the deposit wherein the integrated raise caving mining infrastructure 902 is located. The monitoring system 920 may be configured for collecting monitoring data, analysing monitoring data, storing of monitoring data, and/or transmitting monitoring data via wireless communication means to an automatic or semi-automatic control system 901 of an integrated cave mining infrastructure 902.

The monitoring system 920 comprises amongst others a plurality of monitoring means, a central monitoring unit, data collection units, data storage means, communication devices and/or data analysis tools. The monitoring system 920 may be configured to communicate with the automatic or semi-automatic control system 901 and to transmit data and information generated by the monitoring system to the automatic or semi-automatic control system 901. The monitoring means comprises for example seismic monitoring system, time domain reflectometry technology, open bore holes, cavity scanners, sensors, marker or geophones.

Figure 15:
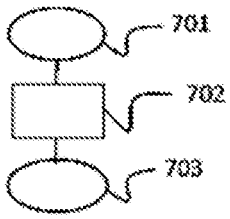
FIG. 15 illustrates a flowchart showing an example of an integrated raise caving mining method.

FIG. 15 illustrates a flowchart showing an example of an integrated raise caving mining method. The method comprises a first step 701 starting the method. A second step 702 comprises the performance of the exemplary method. A third step 703 comprises stopping the method. The second step 702 may comprise developing at least one raise in the rock mass, developing a drawbell in the rock mass, wherein at least a portion of the drawbell is excavated from the at least one raise by drilling, charging and blasting by operating a machinery arranged inside the at least one raise, initiating caving through undercutting, wherein at least a part of an undercut is created by gradually expanding the drawbell in upwards direction by excavation, developing at least two drawpoints into the drawbell, wherein the drawpoints are developed from drifts arranged on different levels, progressively drawing fragmented rock from the at least one drawbell through the drawpoints.

Figure 16:
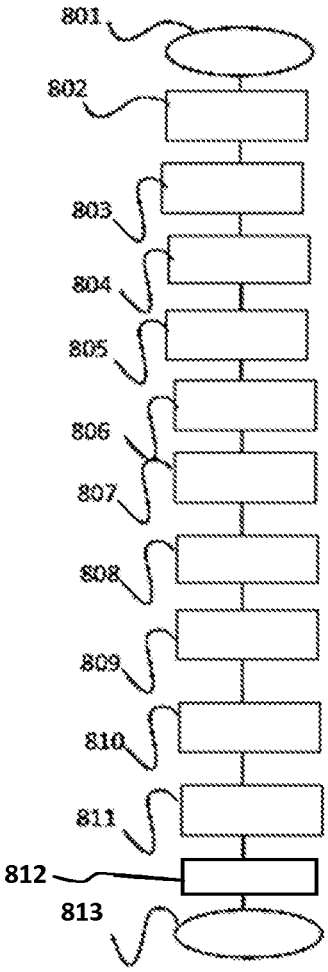
FIG. 16 illustrates a flowchart showing a further example of an integrated raise caving mining method.

FIG. 16 illustrates a flowchart showing a further example of an integrated raise caving mining method. The indicated method steps in the example may be performed in any order.

The method comprises a first step 801 starting the method. A second step 802 comprises developing at least one raise in the rock mass. A third step 803 comprises developing a drawbell in the rock mass, wherein at least a portion of the drawbell is excavated from the at least one raise by drilling and charging by operating a machinery arranged inside the at least one raise and thereafter blasting. A fourth step 804 comprises excavation for developing a roof area of the drawbell being larger than a bottom area of the drawbell. A fifth step 805 comprises initiating caving through undercutting, wherein at least a part of an undercut is created by gradually expanding the drawbell in upwards direction by excavation. A sixth step 806 comprises developing at least two drawpoints into the drawbell, wherein the drawpoints are developed from drifts arranged on different levels. A seventh step 807 comprises progressively drawing fragmented rock from the at least one drawbell through the drawpoints. An eight step 808 comprises initiating caving when the undercut area exceeds a critical area. A ninth step 809 comprises caving the rock mass located above the drawbell, thereby forming a caving stope. A tenth step 810 may comprise pre-conditioning of rock mass located above the drawbell roof by operating a machinery arranged inside the at least one raise. An eleventh step 811 may comprise pre-breaking of rock mass located above the drawbell roof by operating a machinery arranged inside the at least one raise. A twelfth step 812 may comprise a switching from caving to drill and blast for a specific area in the stope. A thirteens step 813 comprises stopping the method.

Figure 17:
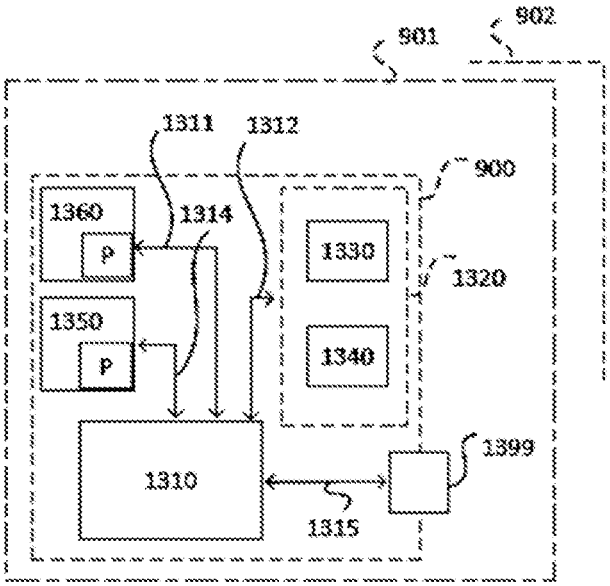
FIG. 17 illustrates a control circuitry adapted to operate an automatic or semi-automatic control system of an integrated cave mining infrastructure, which automatic or semi-automatic control system is configured to perform any exemplary of the integrated raise caving mining method herein described.

FIG. 17 illustrates a control circuitry 900 (such as a central control processor or other computer device) adapted to operate an automatic or semi-automatic control system 901 of an integrated cave mining infrastructure 902, which automatic or semi-automatic control system 901 is configured to perform any exemplary integrated raise caving mining method herein described. The control circuitry 900 is configured to control any exemplary method or methods disclosed herein. The control circuitry 900 comprises a data medium, configured for storing a data program P. The data program P is configured (programmed) for controlling the automatic or semi-automatic control system 901 and/or for controlling the machinery and/or for communicating with the monitoring system 920 in FIG. 14. The data medium comprises a program code readable by the control circuitry 900 for performing any of the exemplary methods herein described, when the data medium is run on the control circuitry 900.

The control circuitry 900 is electrically coupled to a machinery (not shown) comprising a drilling and/or charging device (not shown). The control circuitry 900 is further configured to communicate with the monitoring system 920 via wired and/or wireless communication system to transmit and/or receive monitoring data. The control circuitry 900 is configured to provide that the automatic or semi-automatic control system 901 and/or machinery each performs the method of developing at least one raise in the rock mass, developing a drawbell in the rock mass, wherein at least a portion of the drawbell is excavated from the at least one raise by drilling, charging and blasting by operating a machinery arranged inside the at least one raise, initiating caving through undercutting, wherein at least a part of an undercut is created by gradually expanding the drawbell in upwards direction by excavation, developing at least two drawpoints into the drawbell, wherein the drawpoints are developed from drifts arranged on different levels, progressively drawing fragmented rock from the at least one drawbell through the drawpoints.

The control circuitry 900 may thus also be configured for manoeuvring a transport device, such as a remote-controlled loading device, or continuous draw machinery with conveyors in a drift (not shown). The control circuitry 900 comprises a computer and a non-volatile memory NVM 1320, which is a computer memory that can retain stored information even when the computer is not powered.

The control circuitry 900 further comprises a processing unit 1310 and a read/write memory 1350. The NVM 1320 comprises a first memory unit 1330. A computer program (which can be of any type suitable for any operational data) is stored in the first memory unit 1330 for controlling the functionality of the control circuitry 900. Furthermore, the control circuitry 900 comprises a bus controller (not shown), a serial communication unit (not shown) providing a physical interface, through which information transfers separately in two directions.

The control circuitry 900 may comprise any suitable type of I/O module (not shown) providing input/output signal transfer, an A/D converter (not shown) for converting continuously varying signals from a sensor arrangement (not shown) of the control circuitry 900 configured to determine actual status of the machinery and/or the automatic or semi-automatic control system 901. The control circuitry 900 is configured to, from received control signals, determine the positions of the machinery regarding drilling and operation of the explosive material charging into binary code suitable for the computer, and from other operational data.

The control circuitry 900 also comprises an input/output unit (not shown) for adaptation to time and date. The control circuitry 900 comprises an event counter (not shown) for counting the number of event multiples that occur from independent events in operation of the machinery and/or the automatic or semi-automatic control system 901.

Furthermore, the control circuitry 900 includes interrupt units (not shown) associated with the computer for providing a multi-tasking performance and real time computing. The NVM 1320 also includes a second memory unit 1340 for external sensor check of the sensor arrangement.

A data medium for storing a program P may comprise program routines for automatically adapting the operation of the machinery and/or the automatic or semi-automatic control system 901 in accordance with operational data regarding e.g. the actual status of gradually expanding the drawbell in upward direction by excavation.

The data medium for storing the program P comprises a program code stored on a medium, which is readable on the computer, for causing the control circuitry 900 to perform the method and/or method steps described herein.

The program P further may be stored in a separate memory 1360 and/or in the read/write memory 1350. The program P, in this embodiment, is stored in executable or compressed data format.

It is to be understood that when the processing unit 1310 is described to execute a specific function that involves that the processing unit 1310 may execute a certain part of the program stored in the separate memory 1360 or a certain part of the program stored in the read/write memory 1350.

The processing unit 1310 is associated with a data port 1399 adapted for electrical data signal communication via a first data bus 1315 provided to be coupled to the machinery and/or the automatic or semi-automatic control system 901 for performing any of the exemplary method steps herein described.

The non-volatile memory NVM 1320 is adapted for communication with the processing unit 1310 via a second data bus 1312. The separate memory 1360 is adapted for communication with the processing unit 610 via a third data bus 1311. The read/write memory 1350 is adapted to communicate with the processing unit 1310 via a fourth data bus 1314. After that the received data is temporary stored, the processing unit 1310 will be ready to execute the program code, according to the above-mentioned method.

Preferably, signals (received by the data port 1399) comprise information about operational status of the machinery and/or the automatic or semi-automatic control system 901.

Information and data may be manually fed, by an operator, to the control circuitry 900 via a suitable communication device, such as a computer display or a touchscreen. The exemplary methods herein described may also be partially executed by the control circuitry 900 by means of the processing unit 1310, which processing unit 1310 runs the program P being stored in the separate memory 1360 or the read/write memory 1350. When the control circuitry 900 runs the program P, anyone of the exemplary methods disclosed herein will be executed.

The foregoing description of the preferred embodiments is provided for illustrative and descriptive purposes. It is not intended to be exhaustive, or to limit the embodiments to the variants described. Many modifications and variations will obviously be apparent to one skilled in the art. The embodiments have been chosen and described to best explain the principles and practical applications, and hence make it possible for specialists to understand the invention for various embodiments and with various modifications that are applicable to its intended use.

The present invention is of course not in any way restricted to the examples described above, but many possibilities to modifications, or combinations of the described embodiments thereof should be apparent to a person with ordinary skill in the art without departing from the basic idea of the invention as defined in the appended claims.

The invention claimed is:

1. An integrated raise caving mining method for mining deposits in rock mass comprising:

developing at least one raise in the rock mass, developing a drawbell in the rock mass, wherein at least a portion of the drawbell is excavated from the at least one raise, initiating caving through undercutting, wherein at least a part of an undercut is created by gradually expanding the drawbell in upwards direction by excavation, developing at least two drawpoints into the drawbell, wherein the drawpoints are arranged on different levels, and progressively drawing fragmented rock from the at least one drawbell through the drawpoints.

2. The integrated raise caving mining method according to claim 1, further comprising caving the rock mass located above the drawbell, thereby forming a caving stope.

3. The integrated raise caving mining method according to claim 1, wherein the portion of the drawbell is excavated by drilling blast holes into the rock mass around the raise by operating a machinery arranged inside the raise, and blasting the rock mass by charging and detonating explosives in those blast holes such that the portion of the drawbell is blasted.

4. The integrated raise caving mining method according to claim 1, comprising pre-conditioning of rock mass located above the drawbell roof by operating the machinery arranged inside the at least one raise.

5. The integrated raise caving mining method according to claim 1, wherein at least a part of the undercut is created by gradually expanding the drawbell in the upwards direction without increasing the length of the perimeter of the drawbell roof.

6. The integrated raise caving mining method according to claim 1, wherein the complete drawbell is developed by excavation from the at least one raise.

7. The integrated raise caving mining method according to claim 1, wherein the at least one raise is developed to extend over only a part of the stope height above the drawbell.

8. The integrated raise caving mining method according to claim 1, wherein the at least one raise is developed to extend over the full stope height.

9. The integrated raise caving mining method according to claim 1, wherein blasting takes place in an unconfined environment by drawing previously blasted rock from the drawbell to create a void.

10. The integrated raise caving mining method according to claim 1, wherein blasting takes place in a semi-confined environment by drawing previously blasted rock from the drawbell without creating a void.

11. The integrated raise caving mining method according to claim 1, further comprising switching from caving to drilling and blasting on demand.

12. The integrated raise caving mining method according to claim 1, further comprising re-initiating caving of the stope pre-breaking by drilling, charging and blasting in a part of the stope in specific areas from inside the raise by operating the machinery arranged inside the raise in case caving has stalled.

13. The integrated raise caving mining method according to claim 1, further comprising controlling the cave progression by performing controlling measures means arranged from inside the raise.

14. The integrated raise caving mining method according to claim 1, further comprising controlling cave progression by operating machinery arranged inside the raise and/or by draw strategy and/or draw control.

15. The integrated raise caving mining method according to claim 1, further comprising developing at least one additional drawpoint into the drawbell and developing said at least one additional drawpoint on the same level as pre-existing drawpoints or on a different level than pre-existing drawpoints to stimulate material flow in the drawbell.

16. The integrated raise caving mining method according to claim 1, further comprising developing at least one drawpoint into the stope arranged above the drawbell.

17. The integrated raise caving mining method according to claim 1, further comprising providing the at least one drawbell with multiple drawpoints distributed over at least two levels and distributing said drawpoints evenly such that a favourable drawpoint spacing is achieved and drawing said drawpoints interactively such that interaction between isolated draw zones is achieved.

18. The integrated raise caving mining method according to claim 1, further comprising joining at least two drawbells and forming a coherent stope above the drawbells, and caving the coherent stope.

19. The integrated raise caving mining method according to claim 1, further comprising enlarging the caving stope in lateral direction by developing an additional drawbell at a location next to the caving stope and joining the additional drawbell to the caving stope.

20. The integrated raise caving mining method according to claim 1, further comprising monitoring of caved rock mass by using a remote-controlled monitoring device arranged inside the raise.

21. The integrated raise caving mining method according to claim 1, further comprising monitoring of the caving stope and/or the cave back and/or the caved rock masses by remote controlled monitoring means which is lowered through the raise and into the caving stope.

22. The integrated raise caving mining method according to claim 1, further comprising determining of pre-conditioning needs based on monitoring of spatial distribution and/or behavior of individual formations and zones.

23. The integrated raise caving mining method according to claim 1, wherein the mine layout and infrastructure position are adapted to and determined by production and/or ore body geometry and/or rock mechanics consideration and/or ore flow considerations.

24. The integrated raise caving mining method according to claim 1, wherein the interaction between at least two adjacent stopes generate a regional favourable stress environment for mining infrastructure.

25. An integrated raise caving mining infrastructure configured for mining deposits in a rock mass, which integrated raise caving mining infrastructure comprises;

at least one raise developed in the rock mass;

a drawbell developed in the rock mass, wherein at least a portion of the drawbell is joined to the at least one raise;

an undercut (UC) being configured to initiate caving of rock mass located above the undercut, wherein at least a portion of the undercut is formed as a part of the drawbell; wherein said portion has been created by gradually expanding the drawbell in upward direction by excavation;

at least two drawpoints joined to the drawbell, wherein the drawpoints are joined to drifts arranged on different levels; and a transport device configured to progressively draw fragmented rock from the drawbell.

26. The integrated raise caving mining infrastructure according to claim 25, wherein a caving stope is located above the drawbell.

* * * * *